US011421290B2

(12) United States Patent
Valls Anglés

(10) Patent No.: US 11,421,290 B2
(45) Date of Patent: Aug. 23, 2022

(54) EXTREMELY HIGH CONDUCTIVITY LOW COST STEEL

(71) Applicant: INNOMAQ 21, SOCIEDAD LIMITADA, Madrid (ES)

(72) Inventor: Isaac Valls Anglés, Barcelona (ES)

(73) Assignee: INNOMAQ 21, SOCIEDAD LIMITADA, Madrid (ES)

( * ) Notice: Subject to any disclaimer, the term of this patent is extended or adjusted under 35 U.S.C. 154(b) by 98 days.

(21) Appl. No.: 16/854,509

(22) Filed: Apr. 21, 2020

(65) Prior Publication Data

US 2020/0291496 A1 Sep. 17, 2020

Related U.S. Application Data

(63) Continuation of application No. 15/126,931, filed as application No. PCT/EP2015/055736 on Mar. 18, 2015, now abandoned.

(30) Foreign Application Priority Data

Mar. 18, 2014 (EP) ..... 14382097

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/28*** | (2006.01) |
| ***C22C 38/44*** | (2006.01) |
| ***C22C 38/46*** | (2006.01) |
| ***C22C 38/54*** | (2006.01) |
| ***C21D 1/20*** | (2006.01) |
| ***C21D 1/25*** | (2006.01) |
| ***C21D 6/00*** | (2006.01) |
| *C22C 33/02* | (2006.01) |

(52) U.S. Cl.

CPC ..... *C21D 1/20* (2013.01); *C21D 1/25* (2013.01); *C21D 6/004* (2013.01); *C21D 6/005* (2013.01); *C21D 6/007* (2013.01); *C21D 6/008* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/22* (2013.01); *C22C 38/28* (2013.01); *C22C 38/44* (2013.01); *C22C 38/46* (2013.01); *C22C 38/54* (2013.01); *B22F 2998/10* (2013.01); *C21D 2211/002* (2013.01); *C21D 2211/003* (2013.01); *C22C 33/0257* (2013.01)

(58) Field of Classification Search

CPC ..... C22C 38/00–60

See application file for complete search history.

(56) References Cited

U.S. PATENT DOCUMENTS

| | | | | |
|---|---|---|---|---|
| 4,459,162 A * | 7/1984 | Norstrom | C22C 38/24 420/106 |
| 5,554,233 A * | 9/1996 | Heitmann | C21D 7/13 148/330 |
| 2012/0063946 A1* | 3/2012 | Valls | C22C 38/44 420/108 |
| 2015/0020926 A1* | 1/2015 | Iwamoto | C22C 38/38 148/318 |

FOREIGN PATENT DOCUMENTS

| | | | |
|---|---|---|---|
| WO | WO-2013121794 A1 * | 8/2013 | C22C 38/38 |

OTHER PUBLICATIONS

Tamura et al, "Influence of the Addition of REM and Alloying Elements on the Behavior of MC Carbide Formation During Solidification of 3%V High Speed Tool Steels", Proceedings of the Sixth International Iron and Steel Congress, 1990, Nagoya, ISIJ. pp. 649-650. (Year: 1990).*

* cited by examiner

*Primary Examiner* — Ngoc-Yen Nguyen

(74) *Attorney, Agent, or Firm* — Ladas & Parry LLP

(57) ABSTRACT

The present invention relates to tool steels which present an extremely high conductivity while maintaining high levels of mechanical properties the manufacturing process thereof. Tool steels of the present invention are able to undergo low temperature hardening treatments with good homogeneity of the microstructure and can be obtained at low cost.

20 Claims, 1 Drawing Sheet

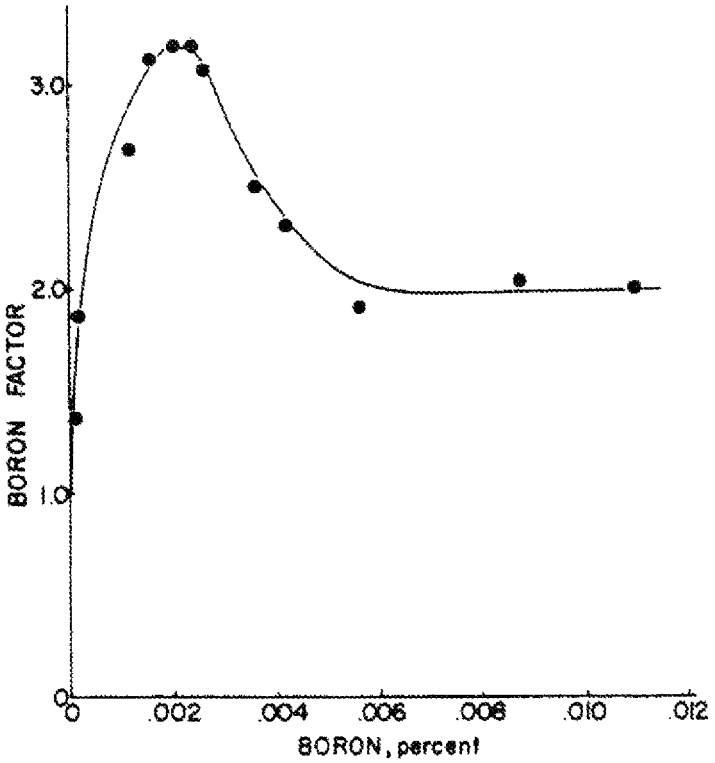
3.0
2.0
1.0
0
BORON FACTOR
0
.002
.004
.006
.008
.010
.012
BORON, percent

EXTREMELY HIGH CONDUCTIVITY LOW COST STEEL

CROSS-REFERENCE TO RELATED APPLICATIONS

This application is a continuation of U.S. Ser. No. 15/126,931 filed 16 Sep. 2016, which is a 371 of International Application Number PCT/EP2015/055736 filed on 18 Mar. 2015, which claims priority to EP application No. 14382097.5 filed on 18 Mar. 2014, contents of both of which are incorporated herein by reference in their entireties.

FIELD OF THE INVENTION

The present invention relates to steels, in particular hot work tool steels which present an extremely high conductivity while maintaining high levels of mechanical properties. Tool steels of the present invention are able to undergo low temperature hardening treatments and can be obtained at low cost.

SUMMARY

For many metal shaping industrial applications where there is a heat extraction from the manufactured product, thermal conductivity is of extreme importance; when this heat extraction is discontinuous, it becomes crucial. Thermal conductivity is related to fundamental material properties like the bulk density, specific heat and thermal diffusivity. Traditionally for tool steels, this property has been considered opposed to hardness and wear resistance since the only way to improve it was by means of decreasing alloying content. During many hot work applications, like plastic injection, hot stamping, forging, metal injection, composite curing among many others, extremely high thermal conductivity is often simultaneously required with wear resistance, strength at high temperatures and toughness. For many of these applications, big cross-section tools are required, for which high hardenability of the material is also necessary.

In many applications like most casting or light alloy extrusion amongst others, thermal fatigue is the main failure mechanism. Thermal fatigue and thermal shock are caused by thermal gradients within the material. In many applications steady transmission states are not achieved due to low exposure times or limited amounts of energy from the source that causes a temperature gradient. The magnitude of thermal gradient for tool materials is also a function of their thermal conductivity (inverse proportionality applies to all cases with a sufficiently small Biot number). Hence, in a specific application with a specific thermal flux density function, a material with a superior thermal conductivity is subject to a lower surface loading, since the resultant thermal gradient is lower. The same applies when the thermal expansion coefficient is lower and the Young's modulus is lower. Therefore an increase in thermal conductivity implies an increase of the tool life. On the other hand, due to the fact that the manufactured piece is able to cool down faster thanks to the rapid heat extraction from the die, cycle time decreases. Both facts lead to a productivity increase.

For minimizing thermal fatigue it is also desirable to increase toughness (typically fracture toughness and CVN). Until the moment, it was believed that high toughness levels were just attainable for low levels of hardness, the same applying for thermal conductivity, decreasing other properties like wear resistance. Also for dies which afterward will need to undergo a surface hardening treatment, like for example nitriding, it is normally necessary that substrate base material has high hardness in order to support the coating, and again high levels of hardness are required. The inventors have surprisingly found that when performing the present invention, it is possible to obtain tool steels with high levels of hardness together with high toughness, good wear resistance and improved thermal conductivity. If performed particularly good, extremely high thermal conductivity levels are attainable in combination with the mentioned mechanical properties.

For some other applications like most of plastic injection for the automotive industry, thick tools are used, especially when sufficient strength is required as for to require a thermal treatment. In this case, it is also very convenient to have a good hardenability to be able to achieve the desired hardness level on surface and, preferably, all the way to the nucleus. Hardenability is inherent of each material and is given by the time available to go from a high temperature, normally above austenization temperature, to low temperatures, normally below martensitic start transformation without entering in any stable phase region like ferrite-perlite zone and/or the bainitic zone. It is well known that pure martensitic structures present higher toughness values once tempered than mixed microstructures with stable phases. For that, the use of severe quenching mediums is needed in order to go from temperatures typically above 700° C. down to temperatures typically below 200° C. For this reason, on the other hand, such treatments are very costly. Moreover, the hardening of the piece is normally done at the final step of the die manufacturing, where the part is most valuable as the material has undergone all required thermomechanical treatments and has already been pre-machined, and where the final form has complex shapes, different thicknesses, inner channels and even sharp corners. Thus, severe quenching is actually not desirable even if the material owes good hardenability, because is more prone to lead to undesirable cracks, often with no possible repair. Steels of the present invention have limited hardenability subjected to heat treating conditions. Fortunately, the inventors studied in the past the existence of other tough microstructures achieved by means of special heat treatments which are able to provide with same levels of toughness or even higher without using severe quenching mediums. These treatments are explained at WO2013167580A1 or WO2013167628A1. The inventors have surprisingly observed that such treatments are also applicable to the steels of the present invention and moreover have good performance in terms of mechanical properties.

Also for such applications where big tools are used, the cost of the material is decisive for its election but without renouncing at mechanical properties. It is possible with the present invention to obtain tool steels with high toughness and high thermal conductivity with a homogeneous microstructure through the whole cross section and for big thicknesses, very adequate for applications requiring low cost materials such as plastic injection, amongst many others.

There are many other desirable properties, if not necessary, for hot work steels that do not necessarily influence the longevity of the tool, but their production costs, like: ease of machining, welding or repair in general, support provided to the coating, costs . . . . Steels of the present invention can undergo specific heat treatments which provide with a soft microstructure which makes easier processes like rough machining or cutting.

In an additional aspect, the invention is related to a process to manufacture a steel, in particular a hot work tool steel, characterized in that the steel is subjected to a martensitic, bainitic or martensitic-bainitic treatment with at least one tempering cycle at temperature above 590° C., so that a steel having a hardness above 47 HRc with the structure at the atomic level (atomic arrangement) prescribed in the present invention whose implementation can be monitored by a thermal diffusivity value greater than 12 $mm^2/s$ or more. In another embodiment, steel having hardness above 50 HRc with a structure at the atomic level (atomic arrangement) prescribed in the present invention whose implementation can be unequivocally measured by a thermal diffusivity value greater than 10 $mm^2/s$ or more is obtainable. In an additional embodiment of this process, the steel is subjected to at least one tempering cycle at temperature above 640° C., so that steel having a hardness of 40 HRc or more presents a with the structure at the sub-nanometric scale prescribed in the present invention whose implementation can be monitored by a thermal diffusivity value greater than 17 $mm^2/s$ or more. It is also possible to subject the steel to at least one tempering cycle at a temperature above 660° C., so that the steel having a hardness of 35HRc or more presents a structure at the sub-nanometric scale (regarding the optimization of density of states and mobility of carriers in all phases) prescribed in the present invention whose implementation can be monitored by a thermal diffusivity value greater than 18 $mm^2/s$ or more.

The authors have discovered that the problem to simultaneously obtain very high thermal conductivity, wear resistance and hardenability, together with good levels of toughness at low cost, can be solved applying certain rules of composition and thermo-mechanical treatments. Some of the selection rules of the alloy within the range and thermo-mechanical treatments required to obtain the desired high thermal conductivity to a high hardness level and wear resistance, are presented in the detailed description of the invention section. Obviously, a detailed description of all possible combinations is out of reach. The thermal diffusivity is regulated by the mobility of the heat energy carriers, which unfortunately cannot be correlated to a singular compositional range and a thermo-mechanical treatment.

STATE OF THE ART

Until the development of high thermal conductivity tool steels (EP 1887096 A1), the only known way to increase thermal conductivity of a tool steel was keeping its alloying content low and consequently, showing poor mechanical properties, especially at high temperatures. Tool steels capable of surpassing 42 HRc after a tempering cycle at 600° C. or more, were considered to be limited to a thermal conductivity of 30 W/mK and a structure at the atomic level (atomic arrangement) prescribed in the present invention whose implementation can be monitored by a thermal diffusivity value greater than of 8 $mm^2/s$ and 6.5 $mm^2/s$ for hardness above 42 HRc and 52 HRc respectively. Tool steels of the present invention have a structure at the atomic level (atomic arrangement) prescribed in the present invention whose implementation can be monitored by a thermal diffusivity value greater than 12 $mm^2/s$ and, often, above 14 $mm^2/s$ for hardness over 50 HRc, and even more than 17 $mm^2/s$ for hardness over 42 HRc, furthermore presenting a very good toughness and at low cost.

BRIEF DESCRIPTION OF THE DRAWING

FIG. 1 is a graph showing the variation of boron factor related to the boron content of the steel.

DETAILED DESCRIPTION OF THE INVENTION

The authors have discovered that the problem of having simultaneously very high thermal conductivity, wear resistance and hardenability, together with good levels of toughness at low cost can be solved with a steel with the features of claim 1 and a method for manufacturing steel with the features of claim 15. Inventive uses and preferred embodiments follow from the other claims.

It is possible within the present invention to obtain steels, in particular tool steels of extremely high thermal conductivity. Also, if the correct rules described in the present invention are applied, it is possible to obtain steels, in particular tool steels of extremely high thermal conductivity together with high mechanical properties, for example high resistance to wear and high toughness. It is also a goal of the present invention to obtain such steels at low cost.

For hot work applications heat extraction rate has a crucial effect on the economics of the process, as the velocity in which the produced piece cools down determines cycle time of the process. Also for high cycle times, the die remains under extreme conditions for longer time periods suffering more erosion and leading to tool life decrease. Many examples can be found, for example plastic injection molding, aluminum die casting or hot stamping, amongst many others. For these applications the use of tool steels with high thermal conductivity is definitely a gain in tool life and also in productivity, as the piece is cooled more rapidly and the machine can decrease production cycle. Therefore high thermal conductivity tool steels where developed for this purpose. To estimate the cooling time of molten material (plastic, aluminum . . . ) in the injection molding process thermal conductivity is commonly used in conjunction with other thermodynamic properties.

A specific thermal diffusivity value cannot be derived from a steel composition; actually thermal diffusivity is a parameter describing a structural feature in the sub-nanometric scale (atomic arrangement, regarding the optimization of density of states and mobility of carriers in all phases). When writing the application, the applicant referring to the Guidelines C-ll, 4.11 (nowadays Guidelines 2012, Part F, Chapter IV, point 4.11, "Parameters") realized that almost all parameters (available) to describe this structural feature in the sub-nanometric scale are unusual parameters and that would be prima facie objectionable on grounds of lack of clarity. The sole exception for unequivocally describe mentioned structural feature in the sub-nanometric scale is thermal diffusivity and therefore this parameter is chosen to reasonably describe the structural feature.

In the meaning of this patent, the values of thermal diffusivity refer to measures at room temperature, otherwise indicated. Although thermal diffusivity is a fundamental property, one preferred way of measuring it is according to international standards ASTM-E1461 and ASTM-E2585 by means of the Flash Method. The present invention is especially interesting for a broad range of applications where extreme thermal conductivity is needed, either at high hardness or low ones. For applications where hardness below 40 HRc is needed, preferably below 39HRc, more preferably below 38HRc or even more preferably below 35 HRc, a structure at the sub-nanometric scale prescribed in the present invention whose implementation can be monitored by a thermal diffusivity value greater than 16 $mm^2/s$, preferably above 17 $mm^2/s$, more preferably more than 18 $mm^2/s$ and even more preferably more than 18.5 $mm^2/s$ is attainable. When performing the invention particularly good, structures at the sub-nanometric scale prescribed in the present invention whose implementation can be monitored by a thermal diffusivity value even greater than 18.8 $mm^2/s$, preferably more than 19 $mm^2/s$, more preferably more than 19.2 $mm^2/s$ and even more preferably more than 19.5 $mm^2/s$ are attainable. For die casting applications requiring intermediate hardness, normally more than 40 HRc, preferably more than 42 HRc, more preferably more than 43 HRc and even more preferably more than 46HRc, structures at the sub-nanometric scale prescribed in the present invention whose implementation can be monitored by a thermal diffusivity value greater than 14 $mm^2/s$, preferably more than 15 $mm^2/s$, more preferably more than 16 $mm^2/s$ and even more preferably more than 16.2 $mm^2/s$ are attainable. When performing the invention particularly good, structures at the sub-nanometric scale prescribed in the present invention whose implementation can be monitored by a thermal diffusivity value greater than 16.5 $mm^2/s$, preferably more than 17 $mm^2/s$, more preferably more than 17.3 $mm^2/s$ and even more preferably more than 17.5 $mm^2/s$ are attainable. For applications requiring high hardness normally above 48 HRc, preferably more than 50HRc, more preferably more than 52 HRc and even more preferably more than 54HRc and also more than 58HRc, structures at the sub-nanometric scale prescribed in the present invention whose implementation can be monitored by a thermal diffusivity value greater than 12.5 $mm^2/s$, preferably more than 13.6 $mm^2/s$, more preferably more than 14.4 $mm^2/s$ and even more preferably more than 14.8 $mm^2/s$ are attainable. When performing the invention particularly good, structures at the sub-nanometric scale prescribed in the present invention whose implementation can be monitored by a thermal diffusivity value greater than even above 15.2 $mm^2/s$ are attainable.

For some applications, desired microstructure is mainly a bainite microstructure; for some less demanding applications, bainite should be at least 20% vol %, preferably 30% vol %, more preferably 50% vol % and even more preferably more than 80% vol %.

For some applications, especially those requiring heavy sections and where homogeneity of the microstructure is desirable with materials presenting, High Temperature bainite is preferred. In this document High Temperature bainite refers to any microstructure formed at temperatures above the temperature corresponding to the bainite nose in the TIT diagram but below the temperature where the ferritic/perlitic transformation ends, but it excludes lower bainite as referred in the literature, which can occasionally form in small amounts also in isothermal treatments at temperatures above the one of the bainitic nose. For some applications of the present invention, the high temperature bainite should be at least 20% vol %, preferably 28% vol %, more preferably 33% vol % and even more preferably more than 45% vol %. For the applications requiring homogeneity in microstructure, the high temperature bainite should be the majority type of bainite and thus from all bainite is preferred at least 50% vol %, preferably 65% vol %, more preferably 75% vol % and even more preferably more than 85% vol % to be High Temperature Bainite. Often high temperature bainite is predominantly Upper Bainite, which refers to the coarser bainite microstructure formed at the higher temperatures range within the bainite region, to be seen in the TI temperature-time-transformation diagram, which in turn, depends on the steel composition. The inventors have found that a way to increase the toughness of the High Temperature Bainite, including the Upper Bainite is to reduce the grain size, and thus for the present invention when Tough Upper Bainite is required, grain sizes of ASTM 7 or more, preferably 8 or more, more preferably 10 or more and even more preferably 13 or more are advantageous.

It is possible with the present invention to obtain steels, in particular tool steels of extremely high conductivity; the inventors have observed that if following some compositional rules and general considerations in the selection of the composition ranges and thermomechanical treatments, the steels of the present invention can also attain very good toughness and good resistance to wear with considerably low alloy content. Main microstructure of the steels of the present invention consist on martensitic or bainitic or at least partially martensitic or bainitic (with some ferrite, perlite or even some retained austenite). It is also possible with the present invention to obtain steels with such improved properties at very low costs.

One strategy to obtain low elements in solid solution maintaining interesting mechanical properties consists on driving most of the elements to especially chosen ceramic strengthening particles, and including the non-metallic part (% C, % B, and % N) to carbides, alternatively nitrides, borides or in-betweens. For this purpose $M_3Fe_3C$ carbides type are one of the most interesting ones because they have high electron density, where M is any metallic element, but most preferably M is Mo and/or W. But there are also other (Mo, W, Fe) carbides with considerably high electron density and tendency to solidify with little structural defects on the lattice so in general it is wished to have predominantly (Mo, W, Fe) carbides (where of course part of the % C can be replaced by % N or % B), usually more than 60%, preferably more than 72%, more preferably more than 82% or even more preferably more than 92% of such kind of carbides. In the meaning of this patent, percentages referring to element content are % wt. For greater thermal conductivity, M should only be Mo or W where other metallic element in solid solution is present in an amount of less than 18%, preferably less than 14%, more preferably less than 8% and even more preferably less than 4%. The amount of Mo and W is of great importance as well as their ratio. One general rule to fix Mo and W content in order to obtain high thermal conductivity as well as preserve high mechanical properties consists on % $Mo+V_2$% W>1.2. Generally, for extremely high thermal conductivity, % Mo should be preferably more than 2.3%, more preferably more than 3.2% and even more preferably more than 3.9%. The usage of only % Mo is advantageous for thermal conductivity. Therefore, for applications requiring extremely high thermal conductivity % Mo can be even more than 4.1%, preferably more than 4.4%, more preferably more than 4.6% and even more preferably more than 4.8%. When it comes to % W, it is desirable to have less than 2.5% W, more preferably less than 1.5% W and even more preferably less than 1% W. On the other hand, depending on the W price, for some a applications where low cost is required, % W is convenient to be smaller than 0.9%, preferably smaller than 0.7%, more preferably smaller than 0.4 or even no intentional % W at all. For applications where thermal conductivity is to be maximised but thermal fatigue has to be regulated, it is normally preferred to have from 1.2 to 3 times more Mo than W, but not absence of W, as % Mo has the disadvantage of providing a higher thermal expansion coefficient presenting negative effects for thermal fatigue. % W has also an effect on the deformation during heat treatment attainable, since the atomic radii mismatch is greater than that of % Mo. Thus for those applications where deformation control during the heat treatment is important, it is desirable that W is not absent, preferably present at least in an amount of 0.4%, more preferably more than 0.8% and even more preferably more than 1.2%. The inventors have found that there are also some elements which dissolve into these types of carbides inducing almost no distortion to the crystalline structure. This is the example of Hf and Zr. These elements have also very high affinity to carbon tending to form separate MC type carbides which also releases C from solid solution on the matrix. For this purpose, it is desirable to have at least 0.02% Hf, preferably more than 0.09% Hf, more preferably more than 0.180% Hf, more preferably 0.44% Hf and even more preferably more than 1% Hf. On the other hand, for Zr is desirable to have at least 0.03% Zr, preferably more than 0.09%, preferably more than 0.18% Zr, more preferably more than 0.52% Zr and even more preferably more than 0.82% Zr. Hf serving as strong carbide former also provides with grain-boundary ductility and increase on oxidation resistance. It is also used to increase strength at high temperatures and also both Hf and Zr owe an inherent resistance to corrosion. Therefore, for applications requiring some ambient resistance, it is desirable to have even more Hf and/or Zr present than the one necessary to combine with nominal C to attain some corrosion and oxidation resistance. In such cases, it can be desirable to have more than 1% Hf, preferably more than 2% Hf and sometimes, depending on the application even more than 3% Hf. The same applies with Zr which can be desirable to have more than 1% Zr, preferably more than 2% Zr and sometimes, depending on the application even more than 3% Zr. On the other hand, for applications requiring high toughness levels, % Hf and/or % Zr should not be very high, as they tend to form big and polygonal primary carbides which act as stress raisers. Therefore, in such cases % Hf is desirable to be less than 0.53%, preferably less than 0.48%, more preferably less than 0.36% and even more preferably less than 0.24%. Regarding % Zr, it is desirable to have less than 0.54%, preferably less than 0.46%, more preferably less than 0.28% and even more preferably less than 0.12%. Depending on the application, it is desirable that % Hf and/or % Zr is totally or partially replaced by % Ta, preferably more than 25% of the amount of Hf and/or Zr, more preferably more than 50% of Hf and/or Zr, even more preferably more than 75% of the of Hf and/or Zr, and even totally replaced.

Hf is obtained as a by-product Zr refining. Due to their similar chemical properties this process is extremely difficult and therefore very costly. Hf is also well known for having high neutron absorption ability which makes it a perfect candidate for nuclear applications. The limited Hf availability leaves very little material for uses other than nuclear applications and therefore in its pure state is one of the most expensive elements in the market. On the other hand, the rejected product coming from this refinement is Zr which in consequence can be found at really low cost. Due to the similar chemical properties of both elements, in some cases where product cost is of great importance, Hf can be partially or even totally, depending on the application, substituted by Zr, sometimes in detriment of losing some thermal conductivity. In such cases, Zr is preferred to be more than 0.06%, preferably more than 0.22% and more preferable more than 0.33%. In some special cases it can be desirable to have even more than 0.42% Zr, whereas Hf is desired to be less than 0.15%, preferably less than 0.08%, more preferably less than 0.05% Hf and even absence of it.

Normally no other metallic element besides the mentioned Fe, Mo, W, Hf, and/or Zr should exceed 20% of the weight percent of the metallic elements of the carbide. Preferably it should not be more than 10% or even better 5%.

The inventors have surprisingly seen that small amounts of % B have a positive effect on increasing thermal conductivity. Therefore, % B is desirable to be at least 1 ppm, preferably 5 ppm, more preferably more than 10 ppm and even more preferably more than 50 ppms. On the other hand, if high toughness with martensitic microstructure is sought then the % B content has to be kept below 598 ppm, preferably below 196 ppm, more preferably below 68 ppms and even more preferably below 27 ppms.

% Cr and % V are elements which have a negative effect in terms of high thermal conductivity because they cause a lot off lattice distortion when dissolved into the carbide matrix. For high thermal conductivity % V should be kept below 0.23%, preferably below 0.15%, more preferably below 0.1% and even more preferably below 0.05%. For attaining an extremely high conductivity, % Cr has to be kept as low as possible, preferably below 0.28%, more preferably below 0.08% and even more preferably below 0.02%. For extremely high thermal conductivity it is also desirable that % Si is as low as possible. The case of % Si is a bit different, since its content can at least be reduced by the usage of refining processes like ESR, but here it is very technologically difficult, due to the small process window, to reduce the % Si under 0.2%, preferably under 0.16%, more preferably under 0.09% and even more preferably under 0.03% and simultaneously attain a low level of inclusions (specially oxides). The highest thermal conductivity can only be attained when the levels of % Si and % Cr lay below 0.1% and even better if the lay below 0.05%.

Other undesired impurities such as O, N, P and/or S should be kept as low as possible for extremely high thermal conductivity, preferably below 0.1%, more preferably below 0.08% and even more preferably below 0.01%.

Proceeding in this way and applying the compositional rules described in the present invention, the inventors have seen very surprisingly that thermal conductivity becomes insensitive to % C content. This fact is much unexpected because until the moment, thermal conductivity was strongly dependent on carbon content being lower for higher C contents. This finding allows producing tool steels with extremely high thermal conductivity and considerably high carbon content, increasing at the same time mechanical properties. Also has a great impact on economical manufacture costs and it is particularly advantageous for high demanding applications.

It is also a peculiarity of the present invention to achieve extremely high conductivity also at high hardness levels. This fact is very advantageous for hot work dies requiring high hardness; for example, most forging applications use hardness in the 48-54 HRc range, plastic injection molding is preferably executed with tools having a hardness around 50-54 HRc, die casting of zinc alloys is often performed with tools presenting a hardness in the 47-52 HRc range, hot stamping of coated sheet is mostly performed with tools presenting a hardness of 48-54 HRc and for uncoated sheets 54-58 HRc. For sheet drawing and cutting applications the most widely used hardness lies in the 56-66 HRc range. For some fine cutting applications even higher hardness are used in the 64-69 HRc, to mention some. With the present invention it is possible to obtain a structure at the atomic level (atomic arrangement, regarding the optimization of density of states and mobility of carriers in all phases) prescribed in the present invention whose implementation can be unequivocally measured by a thermal diffusivity value greater than 13 $mm^2/s$, preferably more than 14 $mm^2/s$ and even more preferably more than 14.7 $mm^2/s$ for harnesses more than 48 HRc, preferably more than 50HRc or even more preferably more than 53 HRc. When performing the invention particularly good, unexpected structures at the atomic level (atomic arrangement, regarding the optimization of density of states and mobility of carriers in all phases) prescribed in the present invention whose implementation can be unequivocally measured by a thermal diffusivity value even greater than 15 $mm^2/s$ are attainable.

With the present invention, attaining extremely high conductivities is also possible not only at room temperature but also at higher working temperatures. In the present invention it is possible to obtain for a temperature of 200° C. and hardness below 40 HRc, preferably below 39HRc, more preferably below 38HRc or even more preferably below 35 HRc, a structure at the sub-nanometric scale prescribed in the present invention whose implementation can be monitored by a thermal diffusivity value greater than 13 $mm^2/s$, preferably above 13.9 $mm^2/s$, more preferably more than 14.5 $mm^2/s$ and even more preferably more than 15 $mm^2/s$ is attainable; at a temperature of 400° C., structures at the sub-nanometric scale prescribed in the present invention whose implementation can be monitored by a thermal diffusivity value greater than 8.99 $mm^2/s$, preferably more than 9.67 $mm^2/s$, more preferably more than 10.1 $mm^2/s$ and even more preferably more than 10.88 $mm^2/s$ are attainable and at a temperature of 600° C. structures at the sub-nanometric scale prescribed in the present invention whose implementation can be monitored by a thermal diffusivity value greater than 5.47 $mm^2/s$, preferably more than 6.64 $mm^2/s$, more preferably more than 6.99 $mm^2/s$ and even more preferably more than 7.4 $mm^2/s$ are attainable. In the present invention it is possible to obtain for a temperature of 200° C. and hardness more than 40HRc, preferably more than 42HRc, more preferably more than 43HRc or even more preferably more than 46 HRc, a structure at the sub-nanometric scale prescribed in the present invention whose implementation can be monitored by a thermal diffusivity value greater than 12.1 $mm^2/s$, preferably above 12.9 $mm^2/s$, more preferably more than 13.4 $mm^2/s$ and even more preferably more than 13.9 $mm^2/s$ is attainable; at a temperature of 400° C., structures at the sub-nanometric scale prescribed in the present invention whose implementation can be monitored by a thermal diffusivity value greater than 8.2 $mm^2/s$, preferably more than 8.78 $mm^2/s$, more preferably more than 9.23 $mm^2/s$ and even more preferably more than 9.89 $mm^2/s$ are attainable and at a temperature of 600° C. structures at the sub-nanometric scale prescribed in the present invention whose implementation can be monitored by a thermal diffusivity value greater than 5.01 $mm^2/s$, preferably more than 5.79 $mm^2/s$, more preferably more than 6.32 $mm^2/s$ and even more preferably more than 6.87 $mm^2/s$ are attainable. In the present invention it is possible to obtain for a temperature of 200° C. and hardness more than 48HRc, preferably more than 50HRc, more preferably more than 54HRc or even more preferably more than 58 HRc, a structure at the sub-nanometric scale prescribed in the present invention whose implementation can be monitored by a thermal diffusivity value greater than 11.47 $mm^2/s$, preferably above 12.01 $mm^2/s$, more preferably more than 12.65 $mm^2/s$ and even more preferably more than 13 $mm^2/s$ is attainable; at a temperature of 400° C., structures at the sub-nanometric scale prescribed in the present invention whose implementation can be monitored by a thermal diffusivity value greater than 7.58 $mm^2/s$, preferably more than 8.01 $mm^2/s$, more preferably more than 8.76 $mm^2/s$ and even more preferably more than 9.1 $mm^2/s$ are attainable and at a temperature of 600° C. structures at the sub-nanometric scale prescribed in the present invention whose implementation can be monitored by a thermal diffusivity value greater than 4.18 $mm^2/s$, preferably more than 4.87 $mm^2/s$, more preferably more than 5.70 $mm^2/s$ and even more preferably more than 6.05 $mm^2/s$ are attainable.

Hence, according to a preferred embodiment of the present invention the steels, specially the extremely high thermal conductivity steels, can have the following composition, all percentages being indicated in weight percent:

| | | | |
|---|---|---|---|
| % $C_{eq}$ = 0.15-2.0 | % C = 0.15-2 | % N = 0-0.6 | % B = 0-4 |
| % Cr = 0-11 | % Ni = 0-12 | % Si = 0-2.4 | % Mn = 0-3 |
| % Al = 0-2.5 | % Mo = 0-10 | % W = 0-10 | % Ti = 0-2 |
| % Ta = 0-3 | % Zr = 0-3 | % Hf = 0-3 | % V = 0-12 |
| % Nb = 0-3 | % Cu = 0-2 | % Co = 0-12 | % Lu = 0-2 |
| % La = 0-2 | % Ce = 0-2 | % Nd = 0-2 | % Gd = 0-2 |
| % Sm = 0-2 | % Y = 0-2 | % Pr = 0-2 | % Sc = 0-2 |
| % Pm = 0-2 | % Eu = 0-2 | % Tb = 0-2 | % Dy = 0-2 |
| % Ho = 0-2 | % Er = 0-2 | % Tm = 0-2 | % Yb = 0-2 |

the rest consisting of iron and trace elements wherein, $$\% C_{eq} = \% C + 0.86 * \% N + 1.2 * \% B,$$

characterized in that $$\% Mo + \tfrac{1}{2} \cdot \% W$$

Note that in metallurgical terms, composition of steels is normally given in terms of Ceq, which is defined as carbon upon the structure considering not only carbon itself, or nominal carbon, but also all elements which have a similar effect on the cubic structure of the steel, normally being B and/or N.

In the meaning of this patent, trace elements refer to any element, otherwise indicated, in a quantity less than 2%. For some applications, trace elements are preferable to be less than 1.4%, more preferable less than 0.9% and sometimes even more preferable to be less than 0.78%. Possible elements considered to be trace elements are H, He, Xe, Be, O, F, Ne, Na, Mg, P, S, Cl, Ar, K, Ca, Fe, Zn, Ga, Ge, As, Se, Br, Kr, Rb, Sr, Tc, Ru, Rh, Pd, Ag, Cd, In, Sn, Sb, Te, I, Xe, Cs, Ba, Re, Os, Ir, Pt, Au, Hg, Tl, Pb, Bi, Po, At, Rn, Fr, Ra, Ac, Th, Pa, U, Np, Pu, Am, Cm, Bk, Cf, Es, Fm, Md, No, Lr, Rf, db, Sg, Bh, Hs, Mt alone and/or in combination. For some applications, some trace elements or even trace elements in general can be quite detrimental for a particular relevant property (like it can be the case sometimes for thermal conductivity and toughness). For such applications it is desirable to keep trace elements below a 0.4%, preferably below a 0.2%, more preferably below 0.14% or even below 0.06%. Needless to say being below a certain quantity includes also the absence of the element. In many applications, the absence of most of the trace elements or even all of them is obvious and/or desirable. As mentioned every trace element is considered a single entity and thus very often for a given application different trace elements will have different maximum weight percent admissible values. Trace elements can be added intentionally to search for a particular functionality including also cost reduction or its presence (when present) can be unintentional and related mostly to impurity of the alloying elements and scraps used for the production of the alloy. The reason for the presence of different trace elements can be different for one same alloy.

It happens often that two steels representing two very different technological advances, and therefore aiming at very different applications, moreover each being absolutely useless for the objective application of the other, can coincide in the compositional range. In most cases the actual composition will never coincide even if the compositional ranges do more or less interfere, in other cases the actual composition could even coincide and the difference would come from the thermo-mechanical treatments applied.

The steels described above are especially suited for applications requiring extremely high thermal conductivity for drastically decrease cycle time during forming process such as die casting among many others, where the cost associated to productivity is relevant.

Some applications require high hardness combined with very high thermal conductivity, like is the case of hot stamping of uncoated sheets. Some of those applications require on top quite high levels of toughness and even fracture toughness and are often very sensible to tooling manufacturing costs. For such applications the requirements are so high that very tight composition rules and very strict requirements on the microstructure especially at the sub-nanometric scale, have to be observed.

In agreement with the teachings of EP 1887096 A1, high thermal diffusivity is solely related to the availability and freedom of movement of the present carriers in all phases. The tool steels of the present invention have two main phase-types: matrix-type phases which are metallic and carbide (nitride boride or even oxide) type phases which are rather ceramic in their nature. Thus density of states and mean free paths for carriers should be maximized in all present phases. The implementation of such optimizations and the attaining of the prescribed structure at the sub-nanometric scale can be monitored by the thermal diffusivity values obtainable at different hardness levels.

Now as EP 1887096 A1 teaches the best way to maximize thermal conductivity is then to make sure that in the final microstructure carbides with high metallic character are present and even more important their crystalline structure should have a very high level of perfection. When it comes to the matrix it is recommended to keep the elements that cause the maximum scattering out of solution, by binding them to the carbides (or nitrides, borides, oxides or mixtures thereof for the same purpose). The attaining of such structural features at the atomic level can be monitored by values of thermal diffusivity attained. For some applications of the present invention it is desirable to have moderate levels of carbon equivalent.

This way of proceeding sets very strict rules at the way the content of carbide builders and carbon equivalent (% Ceq) have to be adjusted, which has important cost implications when extreme high levels of conductivity are to be attained. Now the inventors have seen that surprisingly there is a certain combination of certain elements that allow to implement the teachings of EP 1887096 A1 regarding the optimization of density of states and mobility of carriers in all phases thus rendering the type of described microstructures at the sub-nanometric scale or even more optimized ones as can be unequivocally measured with the extremely high levels of thermal diffusivity but without the burden and associated cost of having to very closely adjust the levels of carbon equivalent to those of the carbide builders. This surprising finding strongly reduces the complexity implied to achieving high thermal conductivity while at the same time increasing the possibilities of achieving other desirable properties at the same time. The inventors have seen that this surprising effect only takes place for moderate levels of carbon equivalent If carbon equivalent is too low then the carbide builders in solid solution in the matrix phases cause a high scattering of the carriers. Thus % Ceq has to be higher than 0.27%, preferably higher than 0.32%, more preferably higher than 0.38% and even more preferably higher than 0.52%. On the other hand too high levels of % Ceq lead to impossibility to attain the required nature and perfection of carbides (nitrides, borides, oxides or combinations) regardless of the heat treatment applied. Therefore % Ceq has to be lower than 1.2%, preferably lower than 0.78%, more preferably lower than 0.67% and even more preferably lower than 0.58%. For this unexpected effect to take place it is important to have a precise level of % Mo. % Mo can be partially replaced with % W but not completely, thus the values is referred here as % Moeq. This replacement takes place in terms of % Moeq, thus every % Mo replaced takes about twice as much % W. The replacement of % Mo with % W will remain lower than 75%, preferably lower than 64%, more preferably lower than 38% and even more preferably lower than 18%. Obviously since the cost of % Mo is often below that of % W and the replacement of % Mo in % Moeq takes twice as much % W, the most economical alternative is when there is no replacement and % W is left at the level of trace element (a complete definition of trace element and weight percent involved has already been provided, but % W was not considered a trace element, but for the applications now described, it would be considered a trace element). Trace elements can be added intentionally to search for a particular functionality including also cost reduction or its presence can be unintentional and related mostly to impurity of the alloying elements and scraps used for the production of the alloy. Even the absence, or presence just as impurity (impurity is one of the types of trace elements) of % W, which could be denominated as absence of % W, can be very advantageous when the minimum cost of alloying is pursued. Therefore, for some cases, % W is desired to be less than 1%. The inventors have seen that for this unexpected result to take place, and having high thermal conductivity with high tolerance to deviations in the alloying from the nominal one allowing a less precise manufacturing route, requires a minimum level of % Moeq below which the carbides that can be formed are not capable of attaining high perfection levels when the % Ceq is not tightly adjusted. Thus % Moeq will have to be higher than 2.8%, preferably higher than 3.2%, more preferably more than 3.7% and even more preferably more than 4.2% for this effect to take place. On the other hand too high levels of % Moeq will lead to situations where there will not exist any heat treatment that can avoid a considerable scattering of carriers in at least one of the matrix phases, and thus extremely high thermal conductivity even when the teachings of EP 1887096 A1 are applied, will only be attainable for a very precise level of % Ceq, often impracticable at industrial scale. Thus % Moeq will have to be lower than 6.8%, preferably lower than 5.7%, more preferably lower than 4.8% and even more preferably lower than 3.9%. The inventors have seen that for some applications requiring good wear resistance in combination with high toughness within the present invention, the following rule should apply:

Ceq should be higher than 0.38%, preferably higher than 0.4%, more preferably higher than 0.42% and even more preferably higher than 0.48%.

Ceq should be lower than 0.72% preferably lower than 0.65%, more preferably lower than 0.62% and even more preferably lower than 0.58% and either % Moeq should be moderate or % V should be present as follows: % Moeq than 9.8% preferably less than 9.5%, more preferably less than 8.9% and even more preferably less than 7.6%; when it comes to % V more than 0.12% preferably more than 0.15%, more preferably more than 0.18% and even more preferably more than 0.23%.

The inventors have seen that for other applications requiring some % Ni content present, the following rule should apply:

% Moeq should be less than 4.4% preferably less than 3.7%, more preferably less than 2.5% and even more preferably less than 1.2% and % Ni should be less than 0.75%, preferably less than 6.2%, more preferably less than 0.58% and even more preferably less than 0.43%.

The inventors have seen that for applications requiring strength in combination with wear resistance, the following rule should apply:

% Moeq should be less than 4.2%, preferably less than 3.7%, more preferably less than 2.8% and even more preferably less than 1.6% and % V should be present in an amount higher than 0.05%, preferably higher than 0.12%, more preferably higher than 0.18% and even more preferably higher than 0.29%.

The authors believe this unexpected results derives from a quite broad range of out of stoichiometry possible for the (Mo, W)3Fe3C type of carbides where the associated crystalline structure imperfections cause rather little scattering. Also the Fe content can be varied significantly with the same effect, even the density of states for electrons and phonons, despite their variation, does not have a dramatic effect on the overall carrier availability. In fact the carbides would probably better be described as $(Mo,W)_{3-x}Fe_{3+x}C$ where x can have negative values and where obviously other carbide formers can substitute Mo, W and/or Fe partially.

The authors have seen that the unexpected effect described in the preceding paragraphs can strongly be encouraged trough the usage of strong carbide formers which present low distortion when incorporated to the molybdenum carbides. But for application requiring high toughness care has to be taken since this strong carbide formers might form their own primary carbides if present in a high enough concentration, and since they often have a rather polygonal morphology they have marked negative effect on the resilience and even fracture toughness of the resulting alloys, when the heat treatments leading to the desired sub-nanometric microstructures, desired for heat conduction purposes, are applied. Thus although for some application it might be desired to not intentionally add those carbide formers, for most applications it is desirable to have % Hf+% Ta+% Zr higher that 0.02%, preferably higher than 0.1%, more preferably higher than 0.2% or even higher than 0.3%. For applications requiring high toughness it is desirable to have % Hf+% Ta+% Zr below 1.4% preferably below 0.98%, more preferably below 0.83% and even more preferably below 0.65%. From all strong carbide formers, the authors have seen that Zr is one of the most interesting ones, since it blends with little distortion in the preferred carbide types for the present invention, and it has a comparatively low cost. Thus it is often the case for implementations of the present invention that % Zr is the strong carbide former with highest concentration. For applications where the presence of strong carbide formers is advantageous as previously described, but where manufacturing cost is of importance will often have % Zr higher than 0.05%, preferably higher than 0.1, more preferably higher than 0.22% and even more preferably higher than 0.4%. For very demanding applications, it is desirable that % Zr is higher than 0.67%, preferably higher than 1.5%, more preferably more than 3.7% and even more preferably even more than 4%. On the other hand when toughness is of importance there is a limitation to %/Zr which will often be below 0.78% preferably below 0.42%, more preferably below 0.28% and even below 0.18%. For some applications, % Zr can be partially or totally replaced by % Hf and/or % Ta.

The inventors have seen that the alloying rules commented so far can lead to the unexpected results commented so far, but can only be implemented for moderate cross sections if high mechanical strength in combination with high toughness are required, since the hardenability in the ferritic/perlitic regime is quite moderate. With this respect the authors have made three unexpected discoveries. The first relates to the usage of % B for the increase of hardenability. And in the present invention a factor much higher than 2.0 (almost factor 10 as can be seen in table 7) can be attained with % B above 25 ppm in contrary to what is the case for conventional steels as can be seen in FIG. 1 where the effect of % B diminishes for % B above 20 ppm and becomes almost constant at 2.0 for % B above 25 ppm. The second unexpected observation relates to the effect of % Ni in low concentrations which can be strongly increased in the presence of other elements and which can be done with a minimal effect on the scattering in the matrix for high hardness levels. The third surprising effect is that of % V which had proved before as even negative for the hardenability in this regime but which has a positive effect if % V is not too high and specially in the presence of % Ni and/or % B. These three discoveries lead to materials which can present high hardness with the desired structure at the atomic level (atomic arrangement) prescribed in the present invention whose implementation can be unequivocally measured by a thermal diffusivity value greater than 8.5 $mm^2/s$ at hardness of more than 48 HRc which have enough trough hardenability in the ferritic/perlitic domain to be able to attain such properties trough a Vacuum $N_2$ hardening process or through the teachings of WO2013167580A1.

Looking in detail at the three unexpected discoveries regarding hardenability, and looking first at the compositional rules derived from these discoveries, the following has been observed:

It is believed that the positive effect of % B is limited to low % C, in fact most literature reports the beneficial effect for % C levels up to 0.2% or eventually 0.25%. The authors have seen that in the present invention % B has a positive effect although the % Ceq values are much higher than those reported in the literature, as can be seen in table 7. Literature also describes the maximum positive effect of % B to take place at around 20 ppm as can be seen in FIG. 1. In the present invention and as can be seen in table 7 the positive effect of % B takes place at higher % B values. So for the steels of the present invention, when high hardenability in the ferritic/perlitic area are looked after, often % B is desired at levels above 1 ppm, preferably above 25 ppm, more preferably above 45 ppm, even more preferably above 58 ppm and even sometimes above 72 ppm. An excess of % B can have the contrary effect depending on the availability of boride forming elements. Also the effect on the toughness can be quite detrimental if excessive borides are formed. So for steels of the present invention requiring high toughness and presenting strong boride formers, % B is desired below 0.2%, preferably below 88 ppm, more preferably below 68 ppm, and even sometimes below 48 ppm When it comes to % Ni, its positive effect in the hardenability was already described in EP2236639B1 The authors have recognized that lower values of % Ni can be employed when in combination with other elements, principally % B and % V. The effect of all carbide builders with stronger affinity for carbon than molybdenum is also acknowledged (Ti, Nb, Zr, Hf, Ta). The usage of this peculiarity of the combined effect or catalytic effect allows to reach higher levels of hardenability with lower % Ni levels, which can be capitalized to attain microstructures in the sub-nanometric scale which are more advantageous for the present invention in the matrix phases, since % Ni is a strong scatterer in a tempered martensite or tempered bainite Fe—C microstructure, especially when present in amounts above 1%, and it is very difficult if not impossible to relocate this element in an effective way, through the possible thermo-mechanical treatments. Thus in the present invention when high hardenability in the ferritic/perlitic regime is desirable often % Ni is present in an amount above 0.2%, preferably above 0.30%, more preferably above 0.42% and even sometimes above 0.75%. On the other hand as mentioned, excessive % Ni might make it impossible to attain extremely low scattering of carriers levels in at least one of the matrix phases, for his reason when extremely high conductivity is desired, then % Ni is present in an amount below 2.7%, preferably below 1.8%, more preferably below 0.8% and even sometimes below 0.68% and even below 0.48% wt. As mentioned, also % B has also positive effect on hardenability. When high hardenability is sought, the combination of % B and % Ni has to be well balanced because otherwise their effect is the cancelled resulting in a decrease of hardenability. If both % B and % Ni are well balanced, it has been surprisingly observed that their effect is additive, leading to high values of hardenability. When using the moderate levels of % Ni indicated here, then, % B is often desirable to be more than 7 ppm, preferably more than 12 ppm, more preferably more than 31 ppm and even more preferably more than 47 ppm. For some applications, excessive % B can be detrimental to hardenability also when moderate % Ni contents are present. In these cases it is desirable to have % B less than 280 ppm, preferably less than 180 ppm, more preferably less than 90 ppm and even less than 40 ppm.

The inventors have seen that while % V above 1.5% has rather a negative effect on the hardenability, lower % V specially when % Ni and/or % B are not absent, present a noticeable hardenability increase in the ferritic/perlitic regime. The authors have seen that to this purpose for some applications it is desirable to have % V more than 0.12, preferably more than 0.22%, more preferably more than 0.42%, more preferably more than 0.52% and even more preferably more than 0.82%.

One of the preferred ways to balance the contents of % W, % Mo and % C in the present invention is through the adhesion to the following alloying rule:

$$\%\ C_{eq}=0.4+(\%\ Mo_{eq(real)}-4)\cdot 0.04173$$

where:

$$Mo_{eq(real)}=\%\ Mo+(AMo/AW)*\%\ W.$$

with:

AMo—molybdenum atomic mass (95.94 u);

AW—tungsten atomic mass (183.84 u);

If the expression is normalized in a parameter $K=(\%\ C_{eq}/0.4+(\%\ Mo_{eq(real)}-4)\cdot 0.04173)$, it is desirable that when % Mo<4 then K<0

As can be seen in table 1, the effect of % B is clearly affected by the presence of % Ni and % V. Thus the amounts desired in the steels of the present invention will depend on the presence and quantity of % Ni and % V.

There are other elements that the authors have seen as strong or at least netto contributors to hardenability in the ferritic/perlitic domain which can be used in combination or as a replacement of % Ni. The most significant being % Cu and % Mn and to a lesser extent % Si. % Cu has the advantage of increasing the ambient resistance against certain environments, but if present in excessive amounts it affects toughness negatively. While the effects of % Ni and % Cu seem to be additive for the steels of the present invention, this is not the case for % Ni and % Mn when both present in high enough amounts. For some applications % Cu is desirable to be more than 0.05%, preferably more than 0.12%, more preferably more than 0.54% and even more preferably more than 0.78%. For some cases, it is preferred to be more than 1%, preferably more than 2.7%, more preferably more than 7.01% and even more preferably more than 5%. For some preferred embodiments, % Cu+% Ni is preferred to be more than 0.1%, preferably more than 0.34%, more preferably more than 0.47% and even more preferably more than 0.6%

The authors have made another surprising observation which is of great interest for certain applications and it is that small amounts of Nb and/or Zr help having high thermal and mechanical properties while maintaining the combined effect of % B and % Ni on hardenability. For some applications the presence of % Nb alone is preferred and there are also applications where the presence of % Zr alone is preferred. On this respect often is desirable to have at least 1 ppm, preferably 2 ppm, more preferably more than 4 ppm and even more preferably more than 12 ppm. If they are used in too much quantity, then they might have a negative effect and the balance between demanded compromise is lost. Then, it is desirable that % Nb and/or % Zr are kept below 105 ppm, preferably less than 64 ppm, more preferably less than 30 ppm and even more preferably less than 16 ppm.

If thermal conductivity is to be improved but % Cr needs to be high and % C between 0.2% wt and 0.8% wt because of a certain application, then the presence of % Zr helps on this respect. For such cases, often % Cr is desirable to be more than 2.4%, preferably more than 3.7%, more preferably more than 4.6% and even more preferably more than 5.7%. To attain higher values of thermal conductivity % Zr will often be desirable to be present, at least, more than 0.1%, preferably more than 0.87%, more preferably more than 1.43% and even more preferably more than 2.23%.

The authors have made many surprising observations leading to the present invention, but probably one of the most surprising relates to the effect of the presence of certain elements in the trace level having a strong effect on the morphology of the bainitic microstructure attainable with certain heat treatments. Thus certain precise levels of % B and even more so with the presence of % Ni (which can be in turn partially or completely replaced with % Cu and % Mn amongst others) can lead to tough bainitic microstructures, and even high temperature bainitic microstructures which are tough even when the grain size is not extremely fine. In the following paragraphs this surprising observations is elaborated.

The authors have made the observation that in other to have a noticeable effect on the attainable bainitic microstructure, % B has to be present in somewhat higher contents that what is required for the increase of the hardenability in the ferrite/perlite domain. For heat treatments like those described in WO2013167580A1 the inventors have seen that at least 56 ppm of % B, preferably 62 ppm of % B or more, preferably 83 ppm of % B or more, more preferably 94 ppm of % B or more, and even 112 ppm of % B or more are required to have this particular effect, the exact minimum content depending on the specific chemical composition and heat treatment chosen. The authors have also seen that for some applications the positive effect on the bainitic microstructure can be overridden by the precipitation of borides depending on the availability of boride forming elements. As a general rule, for the applications where toughness is more critical than wear resistance it is desirable to keep % B below 390 ppm, preferably below 285 ppm, more preferably below 145 ppm and even below 98 ppm. While the limits described so far can be applied in a general way, the inventors have seen that in some circumstances other limits might be more convenient. Whether to apply the general limits or the more specified ones will depend on the concrete application to be optimized. The first set of more specified limits comes about when there is presence of % Ni in the alloy. The authors have seen that % Ni can have an effect in the morphology of high temperature bainite and also an effect on the role of % B. Thus for some applications and when % Ni is present, to have an optimized effect on the bainite morphology when the heat treatments described in WO2013167580A1 are applied, % B rather be kept above 82 ppm, preferably above 92 ppm, more preferably above 380 ppm and even more preferably above 560 ppm but below 35000 ppm, preferably below 1400 ppm, more preferably below 740 ppm, more preferably below 520 ppm and even more preferably below 440 ppm.

As already mentioned in the preceding paragraph, % Ni on its own also can present a positive effect on the morphology of bainite leading to superior toughness for a given grain size. When pursuing this effect it is recommendable to have % Ni above 0.1%, preferably above 0.22% more preferably above 0.35% and even more preferably above 0.48%.

Some further compositional rules can be taken into account for an improved performance in certain other applications. For example, when it comes to wear resistance the presence of Hf and/or Zr have a positive effect. If this is to be greatly increased, then other strong carbide formers with little lattice distortion, like Ta or even Nb can also be used. Then Zr+% Hf+% Nb+% Ta should be above 0.12%, preferably above 0.35%, more preferably above 0.41% and even more preferably above 1.2%. Also % V is good carbide former that tends to form quite fine colonies but as said has a higher incidence on thermal conductivity than other carbide formers. Then, in applications where thermal conductivity should be high but is not required to be extremely high and wear resistance and toughness are both important, it will generally be used with content of more than 0.09%, preferably more than 0.18%, more preferably more than 0.28% and even more preferably more than 0.41%. In fact, in the present invention it has been observed that the effect can be quite positive if a moderate quantity of % V is used and it is balanced with the presence of strong carbide former (preferably Zr and/or Hf). It has been seen that there can be amounts of % V up to 0.9 with practically no formation of primary carbides (obviously depending on the Ceq and the presence of other carbides, and for higher contents of Ceq is necessary to reduce the percentage of V at a maximum of 0.8 and even 0.5 or 0.4 to avoid the presence of primary carbides or massive dissolution in them) and with little dissolution in the carbides of (Fe, Mo, W), especially if used simultaneously with strong carbide forming elements; also there is a displacement of more carbon out of the matrix with the consequent benefit to the overall thermal conductivity (in this case, the benefit is remarkable with % Hf+% Zr+% Ta greater than 0.1, and very significant if it exceeds 0.4 or 0.6, depending on the quantities of % Ceq and % V present). In fact, this combination is highly desirable as the percentage of V as the percentage of Zr, Hf and Ta tend to significantly improve the wear resistance compared to a steel that has only carbides (Fe, Mo, W), the same applied for % Nb. The effect becomes noticeable with % V=0.1 and remarkable with % V=0.3 or 0.5, depending on the level of % Ceq.

When increasing carbide forms content, also % C has to be increased in order to combine with those elements. For applications requiring improved wear resistance it is desirable that % C is above 0.38%, more preferably above 0.4% and even more preferably above 0.51%. This combination of elements provides good wear and abrasion resistance for low % W content which also until the moment was unexpected.

As it is well known, % C content has a strong effect in reducing the temperature at which martensitic transformation starts, from now on $M_s$ according to $M_s$=539-423·% C. Thus higher values of % C is desirable for either high wear resistance applications as described and/or will help for applications where a fine bainite is desirable. In such cases it is desirable to have a minimum of 0.41% of Ceq often more than 0.52% and even more than 0.81%.

Another very surprising finding that the authors have seen is the unexpected effect when using, in the manner described in the present invention, rare earth elements. As defined by IUPAC, a rare earth element (from now on REE) or rare earth metal is one of a set of seventeen chemical elements in the periodic table, specifically the fifteen lanthanides, as well as scandium and yttrium. Scandium and yttrium are considered rare earth elements because they tend to occur in the same ore deposits as the lanthanides and exhibit similar chemical properties. The seventeen rare earth elements known until the moment are Sc, Y, La, Ce, Pr, Nd, Pm, Sm, Eu, Gd, Tb, Dy, Ho, Er, Tm, Yb, Lu. In the last years their use has been largely increased due to the great new devices and demanding applications in the field of electronics or aerospace industries. In metallurgy, it has been observed that rare earth elements work as scavengers of oxygen and other impurities present inherent of the melting process itself. Therefore, the use of rare earth elements might seem suitable for such kind of aim. Depending on certain desired final properties, being able to control the morphology of inclusions present in the steel is of great advantage. On the other hand, the fact that it has also been observed that in general terms such elements do not have a positive effect on hardenability. Still, regardless this fact which indeed is true, the inventors have surprisingly seen that when such elements are combined with other alloying elements in the precise way, the combination of them does have a positive influence on hardenability.

The quantity of REE has to be carefully chosen; the inventors have observed that too less of them does not bring any difference in any remarkable property; on the contrary, too much may have a detrimental effect. Therefore, in general terms it is often desired that the sum of all REE is at least more than 7 ppm, preferably more than 12 ppm, preferably more than 55 ppm, more preferably more than 220 ppm and even more preferably more than 330 ppm or even more than 430 ppm. For special applications, it might be preferable to have even more than 603 ppm. On the other hand, for other applications, it is desirable to have less than 0.6% wt of REE, preferably less than 0.3% wt, more preferably less than 0.1% wt and even more preferably less than 600 ppm. For special applications it might also be preferable to have less than 350 ppm and even less than 90 ppm. There are some properties which might benefit from having REE in even much higher quantities, for example more than 1% wt, preferably more than 1.5% wt, more preferably more than 1.8% wt. For some applications it can be desirable to have even more than 2% wt and for special instances, it might be also desirable to have even more than 3.4% wt.

Among all existing REE, the inventors have seen that the most interesting ones for such purposes are Ce, La, Sm, Y, Ne and Ge, in pure form or in the form of oxide. For the case of % La, for some applications it is desirable to have at least 4 ppm, preferably more than 10 ppm, more preferably more than 23 ppm and even more preferably more than 100 ppms. For other applications the inventors have seen that it is desirable to have at least 0.1% wt, preferably more than 0.5% wt, more preferably more than 0.9% wt and even more preferably more than 1%. For special cases, it is desirable to have even higher amount, for example more than 1.5% wt, more than 2% wt and even more than 4.5% wt. If % La is not used as the only REE and it is combined with other REE, then it is desirable that % La accounts to at least 30% of the total amount of REEs, preferably more than 45% of the total amount of REEs, more preferably more than 67% of the total amount of REEs and even more preferably more than 80% of the total amount of the REEs. In some instances, it is desirable that % La accounts for even more than 91% of the total amount of the REEs and the rest remain as trace elements.

For the case of % Ce, for some applications it is desirable to have at least 5 ppm, preferably more than 15 ppm, more preferably more than 53 ppm and even more preferably more than 150 ppms. For some applications the inventors have seen that it is desirable to have at least 0.09% wt, preferably more than 0.2% wt, more preferably more than 0.7% wt and even more preferably more than 0.9%. For special cases, it is desirable to have even higher amount, for example more than 1% wt, more than 1.5% wt and even more than 3% wt. If % Ce is not used as the only REE and it is combined with other REE, then it is desirable that % La accounts to at least 25% of the total amount of REEs, preferably more than 47% of the total amount of REEs, more preferably more than 73% of the total amount of REEs and even more preferably more than 91% of the total amount of the REEs. In some instances, it is desirable that % Ce accounts for even more than 95% of the total amount of the REEs and the rest remain as trace elements. There is also a variety of what is called Ce-mischmetal or mischmetal, which is an alloy of REE; it is mainly composed of Ce and La (typical composition is about 50% Ce, about 45% La, with traces of Nd and Pr). If this alloy is preferred to be used, then it is desirable to use about 0.5% wt, preferably more than 1.6%, more preferably more than 3.1% and even more preferably more than 4.5% wt.

For the case of % Sm, for some applications it is desirable to have at least 2 ppm, preferably more than 9 ppm, more preferably more than 43 ppm and even more preferably more than 90 ppms. For some applications the inventors have seen that it is desirable to have at least 0.02% wt, preferably more than 0.2% wt, more preferably more than 0.51% wt and even more preferably more than 0.9%. For special cases, it is desirable to have even higher amount, for example more than 1.01% wt, more than 1.3% wt and even more than 3% wt. If % Sm is not used as the only REE and it is combined with other REE, then it is desirable that % Sm accounts to at least 10% of the total amount of REEs, preferably more than 15% of the total amount of REEs, more preferably more than 22% of the total amount of REEs and even more preferably more than 45% of the total amount of the REEs. In some instances, it is desirable that % Sm accounts for even more than 53% of the total amount of the REEs and the rest remain as trace elements.

For the case of % Y, for some applications it is desirable to have at least 9 ppm, preferably more than 34 ppm, more preferably more than 67 ppm and even more preferably more than 200 ppms. For some applications the inventors have seen that it is desirable to have at least 0.12% wt, preferably more than 0.22% wt, more preferably more than 0.9% wt and even more preferably more than 1%. For special cases, it is desirable to have even higher amount, for example more than 1.5% wt, more than 2% wt and even more than 3% wt. If % Y is not used as the only REE and it is combined with other REE, then it is desirable that % Y accounts to at least 30% of the total amount of REEs, preferably more than 45% of the total amount of REEs, more preferably more than 67% of the total amount of REEs and even more preferably more than 80% of the total amount of the REEs. In some instances, it is desirable that % Y accounts for even more than 91% of the total amount of the REEs and the rest remain as trace elements.

For the case of % Gd, for some applications it is desirable to have at least 2 ppm, preferably more than 27 ppm, more preferably more than 53 ppm and even more preferably more than 98 ppms. For some applications the inventors have seen that it is desirable to have at least 0.01% wt, preferably more than 0.1% wt, more preferably more than 0.29% wt and even more preferably more than 0.88%. For special cases, it is desirable to have even higher amount, for example more than 0.9% wt, more than 1.7% wt and even more than 3% wt. If % Gd is not used as the only REE and it is combined with other REE, then it is desirable that % Gd accounts to at least 14% of the total amount of REEs, preferably more than 26% of the total amount of REEs, more preferably more than 37% of the total amount of REEs and even more preferably more than 45% of the total amount of the REEs. In some instances, it is desirable that % Gd accounts for even more than 69% of the total amount of the REEs and the rest remain as trace elements.

For the case of % Nd, for some applications it is desirable to have at least 16 ppm, preferably more than 38 ppm, more preferably more than 98 ppm and even more preferably more than 167 ppms. For some applications the inventors have seen that it is desirable to have at least 0.04% wt, preferably more than 0.14% wt, more preferably more than 0.48% wt and even more preferably more than 1.34%. For special cases, it is desirable to have even higher amount, for example more than 1.5% wt, more than 2% wt and even more than 3% wt. If % Nd is not used as the only REE and it is combined with other REE, then it is desirable that % Nd accounts to at least 35% of the total amount of REEs, preferably more than 49% of the total amount of REEs, more preferably more than 71% of the total amount of REEs and even more preferably more than 83% of the total amount of the REEs. In some instances, it is desirable that % Nd accounts for even more than 93% of the total amount of the REEs and the rest remain as trace elements.

When it comes to the Linear Coefficient of Thermal Expansion, the inventors have surprisingly found that the use of certain REE have a positive effect, especially at low temperatures. If the Thermal Expansion Coefficient is to be minimized, then it is desirable to have % Nd present, with a minimum content of 100 ppm, preferably more than 243 ppm, more preferably more than 350 ppm and even more preferably more than 520 ppms. For this purpose, % W can also be replaced with.

As it has been mentioned, one of the most surprising findings that the inventors have found concerns the fact that when REEs are combined with other elements, they might have unexpected effects on final properties. Therefore, when REEs are present, some considerations have to be taken into account. For example, in the case of % Mo, it is often desirable that its content is more than 2.5%, preferably more than 3.5%, more preferably more than 4.6% and even more preferably more than 6.7%. On the other hand, depending on the properties sought, % Mo is desirable to be less than 2.6%, preferably less than 1.5%, more preferably less than 0.5% or even less than 0.2%. In some cases even absence of it. In the case of % W, it is often desirable that its content is more than 1.21%, preferably more than 2.3%, more preferably more than 2.7% and even more preferably more than 3.1%. On the other hand, depending on the properties sought, % W is desirable to be less than 1.6%, preferably less than 0.9%, more preferably less than 0.43% or even less than 0.11%. In some cases even absence of it. In the case of % Moeq, it is often desirable that its content is more than 2.0%, preferably more than 3.7%, more preferably more than 5.3% and even more preferably more than 6.7%. On the other hand, depending on the properties sought, % Moeq is often desirable to be less than 2.3%, preferably less than 1.97%, more preferably less than 0.67% or even less than 0.31%. In the case of %/Ceq, it is often desirable that it's content is more than 0.18%, preferably more than 0.28%, more preferably more than 0.34% and even more preferably more than 0.39%. On the other hand, depending on the properties sought, % Ceq some other times is desirable to be less than 0.60%, preferably less than 0.56%, more preferably less than 0.48% or even less than 0.43%. In the case of % Ni, it is often desirable that its content is more than 0.1%, preferably more than 0.5%, more preferably more than 1.3% and even more preferably more than 2.9%. On the other hand, depending on the properties sought, % Ni is often desirable to be less than 4%, preferably less than 3.8%, more preferably less than 3.01% or even less than 2.8%. In some cases even absence of it. In the case of % B, it is often desirable that it's content is more than 3 ppm, preferably more than 14 ppm, more preferably more than 50 ppm and even more preferably more than 150 ppm %. On the other hand, depending on the properties sought, % B is often desirable to be less than 1.64%, preferably less than 0.4%, more preferably less than 0.1% or even less than 0.02%. In some cases even absence of it. In the case of % Cr, it is often desirable that it is less than 2.9%, preferably less than 1.7%, more preferably less than 0.8% or even less than 0.3%. For precise applications even less than 0.1% or even absence of it. On the other hand, depending on the properties sought, % Cr is often desirable to be more than 2.8%, preferably more than 3.7%, more preferably more than 5.7% and even more preferably more than 9.7%. In the case of % V, it is often desirable that its content is more than 0.2%, preferably more than 0.5%, more preferably more than 1.1% and even more preferably more than 2.04%. On the other hand, depending on the properties sought, % V is often desirable to be less than 12%, preferably less than 8.7%, more preferably less than 6.4% or even less than 4.3%. In some cases even absence of it. In the case of % Zr, it is often desirable that it's content is more than 0.03%, preferably more than 0.2%, more preferably more than 0.8% and even more preferably more than 0.99%. On the other hand, depending on the properties sought, % Zr is then desirable to be less than 3%, preferably less than 2.4%, more preferably less than 1.7% or even less than 1.2%. In some cases even absence of it.

For some applications, it has been observed that % Mo will often be desirable to be of more than 0.98% wt, preferably more than 1.2% wt, more preferably more than 1.34% wt and even more preferably more than 1.57% wt. In the case of % Cr, it is often desirable to be less than 5.2% wt, preferably less than 4.8%, more preferably less than 4.2% wt and even more preferably less than 3.95% wt. For other cases, it is desirable that % Cr is even lower, less than 2.8% wt, preferably less than 2.69% wt, more preferably less than 1.8% wt and even more preferably less than 1.76% wt. For certain cases, it is desirable to have simultaneously low % Cr and high % Mo. For some other applications it has also been observed that it is desirable to have % Cr and The authors have observed that for intermediate % Cr, that is more than 0.4% wt, preferably more than 2.2% wt, more preferably more than 3.2% wt and even more preferably more than 4.2% wt, then high levels of thermal conductivity can be achieved if following the indications of the present invention and drawing special attention to % Zr, where % Zr is desirable to be more than 0.4% wt, preferably more than 0.8% wt, more preferably more than 1.2% wt and even more preferably more than 1.6% wt. It has to be considered that for some applications, % Cr should not be very high, as then it will tend to form primary carbides which is detrimental for some applications. In such cases, it is desirable that % Cr is less than 8.6%, preferably less than 7.7% more preferably less than 7.2% wt, more preferably less than 6.8% wt and even more preferably less than 5.8% wt. Such embodiments only work for certain C contents which cannot be too low, that is that preferred % C is more than 0.26% wt, preferably more than 0.32% wt, more preferably more than 0.36% wt and even more preferably more than 0.42% wt. In this application, the authors have also observed that carbide formers stronger than iron except Nb, Hf and should be avoided, and the sum of % Ta+% Ti should be less than 1.6% wt, preferably less than 0.8% wt, more preferably less than 0.4% wt and even more preferably less than 0.18% wt.

The authors have also observed that if % B is present in an amount of more than 3 ppm, preferably more than 12 ppm, more preferably more than 60 ppm and even more preferably more than 100 ppm, then excessive % Co are detrimental for several applications. Then % Co is desirable to be <9% wt, preferably less than 7% wt, more preferably less than 5% wt and even more preferably less than 3% wt.

The authors have observed that for some applications % Zr is desirable to be >0.01% wt but less than 0.1% wt, preferably less than 0.12% wt, more preferably less than 0.08% wt and even more preferably less than 0.06% wt. When having this levels of % O/Zr, it is especially interesting that % C is not too low, that is more than 0.26% wt, preferably more than 0.32% wt, more preferably more than 0.36% wt and even more preferably more than 0.42% wt. For some applications, it is moreover interesting that % Co is not exaggerated high, that is less than 6% wt, preferably less than 4.8% wt, more preferably less than 2.8% wt and even more preferably less than 1.8% wt. For some applications, where there is % B present, more than 6% wt, preferably more than 17% wt, more preferably more than 52% and even more preferably more than 222 ppm, REE are present in an amount of more than 60 ppm, preferably more than 120 ppm and even more preferably more than 220 ppm and % Cr is high, more than 2.8% wt, preferably more than 3.8% wt and even more preferably more than 4.8% wt, it is preferable that % Mn is low, less than 1.2%, preferably less than 0.8% wt and more preferably less than 0.4% wt.

According to another preferred embodiment of the present invention the steels, especially high thermal conductivity and high wear resistance steels can have the following composition, all percentages being indicated in weight percent:

| | | | |
|---|---|---|---|
| % $C_{eq}$ = 0.15-2.0 | % C = 0.15-0.9 | % N = 0-0.6 | % B = 0-2 |
| % Cr = 0-11.0 | % Ni = 0-12 | % Si = 0-2.4 | % Mn = 0-3 |
| % Al = 0-2.5 | % Mo = 0-10 | % W = 0-6 | % Ti = 0-2 |
| % Ta = 0-3 | % Zr = 0-3 | % Hf = 0-3 | % V = 0-12 |
| % Nb = 0-3 | % Cu = 0-2 | % Co = 0-12 | % Lu = 0-2 |
| % La = 0-2 | % Ce = 0-2 | % Nd = 0-2 | % Gd = 0-2 |
| % Sm = 0-2 | % Y = 0-2 | % Pr = 0-2 | % Sc = 0-2 |
| % Pm = 0-2 | % Eu = 0-2 | % Tb = 0-2 | % Dy = 0-2 |
| % Ho = 0-2 | % Er = 0-2 | % Tm = 0-2 | % Yb = 0-2 |

the rest consisting of iron and trace elements wherein, $$\% C_{eq} = \% C + 0.86 * \% N + 1.2 * \% B,$$

characterized in that $$\% Mo + \tfrac{1}{2} \cdot \% W$$

The steels described above can be particularly interesting for applications requiring steel with high thermal conductivity, especially when high levels of wear resistance are desirable.

Very significant are also the heat treatments and how those heat treatments are applied. For many applications of the present invention, the preferred microstructure is predominantly bainitic, at least 50% vol %, preferably 65% vol %, more preferably 76% vol % and even more preferably more than 92% vol %, since is normally the type of microstructure easier to attain in heavy sections and also because is the microstructure normally presenting the highest secondary hardness difference upon proper tempering. In the meaning of this patent, bainite is any microstructure obtained after a heat treatment which is not martensite, ferrite, retained austenite or any other non-equilibrium microstrucuture like trostite, sorbite . . . , which preferably forms below 700° C. but above $M_s$+50° C., more preferably below 650° C. but above $M_s$+55° C. and even more preferably below 600° C. but above $M_s$+60° C., to be seen in the TIT temperature-time-transformation diagram, which in turn, depends on the steel composition. Often high temperature bainite is predominantly Upper Bainite, which refers to the coarser bainite microstructure formed at the higher temperatures range within the bainite region, to be seen in the TIT temperature-time-transformation diagram, which in turn, depends on the steel composition. The same applies for low temperature bainite which is known as Lower Bainite and refers to the finer bainite microstructure formed at lower temperature range within bainite region, to be seen in the TIT temperature-time-transformation diagram, which in turn, depends on the steel composition.

If the steels of the present invention undergo the specific heat treatments described in WO2013167580A1, combined with the fact that thanks to % C content $M_s$ temperature is lowered an amount of 539-423·% C Celsius, then tough bainitic structures are attainable. With these treatments, it is possible to obtain a microstructure which is able to raise its hardness an amount of at least 4 HRc, preferably more than 6HRc, more preferably more than 9 HRc and even more preferably more than 12 HRc with hardening at low temperature below austenitization temperature. This fact has big advantages, as the mentioned below austenitization hardening heat treatment have small amount of deformation associated to them, and therefore amount of final machining decreases considerably or even disappears. On the other hand, thanks to the ability of raising its hardness with such treatments, it is possible for the steels of the present invention to be delivered at low hardness, where rough machining can be done without affecting cost (machining at high hardness is really costly). Therefore, it is advantageous to apply the heat treatment of WO2013167580A1 to the steels of the present invention when abundant machining has to be undergone by the steel, and yet high bulk working hardness is desirable, particularly advantageous if more than a 10% of the original weight of the steel block has to be removed to attain the final geometry, more advantageous when more than 26% has to be removed, and even more advantageous when more than 54% has to be removed. As a result, considerably high reduction costs associated to machining can be achieved.

The present invention is advantageous when applying the thermal treatment described in WO2013/167628, where the thermal treatment can be followed by at least one tempering cycle desirably above 500° C., preferably above 550° C., more preferably above 600° C. and even more preferably above 620° C. Often more than one cycle is desirable, more preferably more than one cycle to separate the alloy cementite to dissolve the cementite in solid solution and to separate the carbide formers stronger than iron.

Alternatively for applications requiring the toughness at higher temperatures, the problem can be solved with the presence of enough alloying elements and the proper tempering strategy to replace most $Fe_3C$ with other carbides and thus attaining high toughness even for coarser bainite. Upon formation of the bainite the steel is tempered with at least one tempering cycle at a temperature above 500° C. to ensure that a significant portion of the cementite is replaced by carbide-like structures containing carbide formers stronger than iron. Also the traditional way can be used in certain instances, consisting in avoiding coarse $Fe_3C$ and/or its precipitation on grain boundaries with the additions of elements that promote its nucleation like Al, Si . . . .

In yet a further embodiment of the method of the invention, at least 70% of the bainitic transformation is made at temperatures below 400° C. and/or the thermal treatment includes at least one tempering cycle at a temperature above 500° C. to ensure separation of stronger carbide formers carbides, so that most of the attained microstructure, with the exception of the eventual presence of primary carbides, is characterized by the minimization of rough secondary carbides, in particular at least 60% in volume of the secondary carbides has a size of 250 nm or less, such that a toughness of 10 J CVN or more is attained.

In an additional embodiment of the method of the invention, the composition and tempering strategy is chosen so that high temperature separation secondary carbide types such as types MC, MC-like type as M4C3, M6C and M2C are formed, in such a manner that a hardness above 47 HRc is obtainable even after holding the material for 2 h at a temperature of 600° C. or more.

t is especially interesting for the steels of the present invention to undergo the thermo-mechanical process above described followed by the heat treatments of WO2013167580A1, where it is possible to obtain high toughness levels combined with extremely high thermal conductivity. In the meaning of notch sensitivity it is possible to achieve more than 5 J CVN, more preferably more than 10 J CVN and even more preferably more than 15 J CVN. When performing the invention particularly good, then fracture toughness of more than 20 J CVN and even more than 31 J CVN are possible.

Steels of the present invention are also well suited for undergoing surface hardening treatments. Diffusion processes, like nitriding (plasma, gas . . . ), carbonitriding . . .

amongs many others are apropiate for thin layer thicknesses. Also thermal spray technologies are suited (plasma, HVOF, cold spray, . . . ). It is particularly advantageous for steels of the present invention when the steel requires a harder surface for the application and the nitriding or coating step is made coincide with the hardening step described in the lines above.

In other occasions, final product cost is the most important issue to take into account. As explained before, the usage of low temperature hardening treatments decreases considerably production costs as machining step is done at low hardness, normally below 45HRc, preferably below 42HRc, more preferably below 40HRc and even more preferably below 38HRc. The described treatments are also independent of cross section which has a great advantage for big molds where properties are necessary to be kept constant all through the whole cross section of the tool. From the compositional point of view, for such applications it is desirable not to use expensive alloying elements like Hf or W. Then it is advisable to have less than 0.5% Hf, preferably less than 0.2% Hf, more preferably less than 0.09% and depending on the application even absence of % Hf. Depending on W price raising and for applications requiring high alloying content with high conductivity and strength, % Mo is desirable to be more than 4.5%, more preferably more than 4.8% and even more than 5.8%. In such cases it can be also desirable to lower % W content, preferably less than 3% W, more preferably less than 1.5% W and depending on the application even absence of % W. For some applications Ceq is desirable to be more than 0.15%, preferably more than 0.18%, more preferably more than 0.22% and even more preferably more than 0.26%. For some other cases Ceq is desirable to be less than 0.68%, preferably less than 0.54%, more preferably less than 0.48% and even more preferably less than 0.32%. For some applications C is desirable to be more than 0.15%, preferably more than 0.14%, more preferably more than 0.24% and even more preferably more than 0.28%. For some other cases C is desirable to be less than 0.72%, preferably less than 0.58%, more preferably less than 0.42% and even more preferably less than 0.38%. For some applications Moeq is desirable to be more than 1.5%, preferably more than 1.8%, more preferably more than 2.2% and even more preferably more than 2.8%. For some other cases Moeq is desirable to be less than 5.2%, preferably less than 4.2%, more preferably less than 3.6% and even more preferably less than 2.8%. For some applications Mo is desirable to be more than 1.5%, preferably more than 2.1%, more preferably more than 2.9% and even more preferably more than 3.2%. For some other cases Mo is desirable to be less than 5.4%, preferably less than 4.8%, more preferably less than 3.2% and even more preferably less than 2.5%.

It is then a goal of the present invention the obtaining of steels with high and extremely high thermal conductivity, high toughness and high microstructural uniformity for big cross sections, which makes it adequate for applications demanding low costs as for example for plastic injection molding. In such cases the usage of the present invention can lead to very significant cost savings.

According to another preferred embodiment of the present invention the steels can have the following composition, all percentages being indicated in weight percent:

| | | | |
|---|---|---|---|
| % $C_{eq}$ = 0.15-2.0 | % C = 0.15-0.9 | % N = 0-0.6 | % B = 0-1 |
| % Cr = 0-11.0 | % Ni = 0-12 | % Si = 0-2.5 | % Mn = 0-3 |
| % Al = 0-2.5 | % Mo = 0-10 | % W = 0-10 | % Ti = 0-2 |
| % Ta = 0-3 | % Zr = 0-3 | % Hf = 0-3 | % V = 0-12 |
| % Nb = 0-3 | % Cu = 0-2 | % Co = 0-12 | % Lu = 0-2 |
| % La = 0-2 | % Ce = 0-2 | % Nd = 0-2 | % Gd = 0-2 |
| % Sm = 0-2 | % Y = 0-2 | % Pr = 0-2 | % Sc = 0-2 |
| % Pm = 0-2 | % Eu = 0-2 | % Tb = 0-2 | % Dy = 0-2 |
| % Ho = 0-2 | % Er = 0-2 | % Tm = 0-2 | % Yb = 0-2 |

the rest consisting of iron and trace elements wherein, $$\% C_{eq} = \% C + 0.86 * \% N + 1.2 * \% B,$$

characterized in that

% Mo+½·% W

The steels described above can be particularly interesting for applications requiring steel with high thermal conductivity while production costs have to be maintained as low as possible.

Tool steel of the present invention can be manufactured with any metallurgical process, among which the most common are sand casting, lost wax casting, continuous casting, melting in electric furnace, vacuum induction melting. Powder metallurgy processes can also be used along with any type of atomization and subsequent compacting as the HIP, CIP, cold or hot pressing, sintering (with or without a liquid phase), thermal spray or heat coating, to name a few of them. The alloy can be directly obtained with the desired shape or can be improved by other metallurgical processes. Any refining metallurgical process can be applied, like ESR, AOD, VAR . . . . Forging or rolling are frequently used to increase toughness, even three-dimensional forging of blocks. Tool steel of the present invention can be obtained in the form of bar, wire or powder for use as solder alloy. Even, a low-cost alloy steel matrix can be manufactured and applying steel of the present invention in critical parts of the matrix by welding rod or wire made from steel of the present invention. Also laser, plasma or electron beam welding can be conducted using powder or wire made of steel of the present invention. The steel of the present invention could also be used with a thermal spraying technique to apply in parts of the surface of another material. Obviously the steel of the present invention can be used as part of a composite material, for example when embedded as a separate phase, or obtained as one of the phases in a multiphase material. Also when used as a matrix in which other phases or particles are embedded whatever the method of conducting the mixture (for instance, mechanical mixing, attrition, projection with two or more hoppers of different materials . . . ).

The present invention is especially well suited to obtain steels for the hot stamping tooling applications. The steels of the present invention perform especially well when used for plastic injection tooling. They are also well fitted as tooling for die casting applications. Another field of interest for the steels of the present document is the drawing and cutting of sheets or other abrasive components. Also for medical, alimentary and pharmaceutical tooling applications the steels of the present invention are of especial interest.

Examples

TABLE 1

| | Compositions | | | | | | | | | |
|---|---|---|---|---|---|---|---|---|---|---|
| | % C | % Mo | % W | % Hf | % Zr | % B | % Ni | % V | Others | REE |
| ID1 | −0.29 | 3.6 | 1.09 | 0.36 | 0.11 | 0.004 | <0.005 | <0.005 | | |
| ID2 | 0.265 | 3.3 | 1 | 0.142 | 0.044 | 0 | 0 | 0 | | |
| ID3 | 0.529 | 3.3 | 1 | 0.182 | 0.054 | 0 | 0 | 0 | | |
| ID4 | 0.299 | 3.54 | 1.27 | 0.036 | 0.11 | 0.004 | <0.005 | <0.005 | | |
| IDS | 0.277 | 3.84 | 1.12 | 0.36 | 0.11 | 0.004 | <0.005 | <0.005 | Cu, Al = 0.1 | |
| ID6 | 0.293 | 3.63 | 1.44 | 0.36 | 0.11 | 0.004 | <0.005 | <0.005 | | |
| ID7 | 0.59 | 3.63 | 1.44 | 0.36 | 0.11 | 0.004 | <0.005 | <0.005 | | |
| ID8 | 0.511 | 3.229 | 0.977 | 0.349 | 0.108 | 0.004 | <0.005 | <0.005 | | |
| ID9 | 0.235 | 3.24 | 0.981 | 0.324 | 0.099 | 0.0036 | <0.005 | <0.005 | | |
| ID10 | 0.284 | 3.3 | 1 | 0.24 | 0.09 | 0 | 0 | 0 | | |
| ID11 | 0.579 | 3.3 | 1 | 0.22 | 0.09 | 0 | 0 | 0 | | |
| ID12 | 0.253 | 3.3 | 1 | 0.245 | 0.066 | 0 | 0 | 0 | | |
| ID13 | 0.558 | 3.3 | 1 | 0.24 | 0.05 | 0 | 0 | 0 | | |
| ID14 | 0.53 | 3.3 | 0 | 0.22 | 0.08 | 0 | 0 | 0 | | |
| ID15 | 0.38 | 3.3 | 1 | 0.24 | 0.08 | 0 | 0 | 0 | | |
| ID16 | 0.48 | 3.3 | 1 | 0.24 | 0.08 | 0 | 0 | 0 | | |
| ID17 | 0.29 | 3.3 | 1 | 0.23 | 0.08 | 0.006 | 0 | 0 | | |
| ID18 | 0.29 | 3.3 | 1 | 0.21 | 0.08 | 0.001 | 0 | 0 | | |
| ID19 | 0.29 | 3.8 | 0 | 0.22 | 0.08 | 0 | 0 | 0 | | |
| ID20 | 0.27 | 2 | 3.5 | 0.21 | 0.08 | 0 | 0 | 0 | | |
| ID21 | 0.306 | 3.3 | 0 | 0.22 | 0.07 | 0 | 0 | 0 | | |
| ID22 | 0.38 | 3.8 | 0 | 0.26 | 0.1 | 0.001 | 0 | 0 | | |
| ID23 | 3.369 | 3.886 | 1.090 | 0.36 | 0.11 | 0.004 | <0.02 | <0.01 | | |
| ID24 | 0.468 | 4.370 | 1.090 | 0.36 | 0.11 | 0.004 | <0.02 | <0.01 | | |
| ID25 | 0.580 | 5.324 | 1.070 | 0.36 | 0.11 | 0.004 | <0.02 | <0.01 | | |
| ID26 | 0.491 | 4 | 0 | 0.18 | 0.10 | 0.000 | 0.000 | 0.000 | | |
| ID27 | 0.459 | 4 | 0 | 0,16 | 0.10 | 0.003 | 0.000 | 0.000 | | |
| ID28 | 0.349 | 3.8 | 0 | 0.1 | 0.170 | 0.003 | 0.000 | 0.000 | | |
| ID29 | 0.335 | 3.8 | 0 | 0.1 | 0.200 | 0.008 | 0.000 | 0.000 | | |
| ID30 | 0.302 | 3 | 0 | 0.1 | 0.870 | 0.003 | 0.000 | 0.000 | | |
| ID31 | 0.343 | 3 | 0 | 0.1 | 0.390 | 0.004 | 0.000 | 0.000 | | |
| ID32 | 0.300 | 3.3 | 1 | 0.23 | 0.080 | 0.005 | 0.000 | | | |
| ID33 | 0.300 | 3.3 | 1 | 0.23 | 0.080 | 0.007 | 0.000 | | | |
| ID34 | 0.300 | 3.3 | 1 | 0.23 | 0.080 | 0.008 | 0.000 | | | |
| ID35 | 0.300 | 3.300 | 1.000 | 0.230 | 0.080 | 0.005 | 0.000 | 0.000 | | |
| ID36 | 0.42 | 3.8 | 0 | 0 | 0.2 | 0.06 | 0 | 0 | | |
| ID37 | 0.42 | 3.8 | 0 | 0 | 0.2 | 0.006 | 0 | 0 | | |
| ID38 | 0.42 | 4.2 | 0 | 0 | 0.08 | 0.006 | 0 | 0.5 | | |
| ID39 | 0.42 | 4.2 | 0 | 0 | 0.08 | 0.06 | 0 | 0.5 | | |
| ID40 | 0.42 | 4.2 | 0 | 0 | 0.08 | 0 | 0.8 | 0.5 | | |
| ID41 | 0.42 | 4.2 | 0 | 0 | 0.08 | 0 | 0.8 | 0.5 | | |
| ID42 | 0.52 | 4.2 | 0 | 0 | 0.08 | 0.06 | 0.8 | 0.5 | | |
| ID43 | 0.52 | 4.2 | 0 | 0 | 0.08 | 0.006 | 0.8 | 0.5 | | |
| ID44 | 0.35 | 3.3 | 0 | 0 | 0.2 | 0.006 | 0.4 | 0.4 | | |
| ID45 | 0.35 | 3.3 | 0 | 0 | 0.2 | 0.006 | 0.6 | 0.4 | | |
| ID46 | 0.35 | 3.3 | 0 | 0 | 0.2 | 0.0025 | 0.6 | 0.4 | | |
| ID47 | 0.35 | 3.3 | 0 | 0 | 0.2 | 0.006 | 0.8 | 0.4 | | |
| ID48 | 0.35 | 3.3 | 0 | 0 | 0.2 | 0.006 | 0 | 0.4 | Cu = 0.6 | |
| ID49 | 0.35 | 3.3 | 0 | 0 | 0.2 | 0.006 | 0.3 | 0.4 | Cu = 0.3 | |
| ID50 | 0.35 | 3.3 | 0 | 0 | 0.2 | 0.009 | 0.4 | 0.4 | | |
| ID51 | 0.35 | 3.3 | 0 | 0 | 0.2 | 0.006 | 0.4 | 0 | | |
| ID52 | 0.35 | 3.3 | 0 | 0 | 0.2 | 0.009 | 0 | 0.4 | Mn = 1 | |
| ID53 | 0.36 | 3.86 | 0 | 0.25 | 0.1 | 0.001 | 0 | 0 | | |
| ID54 | 0.53 | 4.1 | 0 | 0 | 0.19 | 0.006 | 0 | 0 | | |
| ID55 | 0.338 | 3.8 | 0 | 0 | 0 | 0.001 | 0 | 0 | | |
| ID56 | 0.216 | 3.8 | 0 | 0 | 0 | 0.001 | 0 | 0 | | |
| ID57 | 0.36 | 3.86 | 0 | 0.25 | 0.1 | 0.001 | 0 | 0 | | |
| ID58 | 0.31 | 3.56 | 0 | 0.27 | 0.11 | 0 | 0 | 0 | | |
| ID59 | 0.3 | 3.8 | 0 | 0 | 0 | 0.001 | 0 | 0 | | |
| ID60 | 0.53 | 4.1 | 0 | 0 | 01.9 | 0.006 | 0 | 0 | | |
| ID61 | 0.23 | 2.2 | 0 | 0 | 0.12 | 0.06 | 0 | 0 | | |
| ID62 | 0.26 | 2.8 | 0 | 0 | 0.18 | 0.06 | 0 | 0 | | |
| ID63 | 0.27 | 3.3 | 0 | 0 | 0.2 | 0.06 | 0 | 0 | | |
| ID64 | 0.23 | 1.8 | 0 | 0 | 0.1 | 0.06 | 0 | 0 | | |
| ID65 | 0.39 | 3.71 | 2.2 | 0 | 0 | 0 | 0.84 | 0.6 | Si = 0.05, Mn = 0.02, Cr = 0.01 | |
| ID66 | 0.31 | 3.3 | 0.8 | 0 | 0 | 0 | 0.8 | 0 | | |
| ID67 | 0.62 | 8.01 | 3.75 | 0 | 0 | 0 | 0.28 | 0.1 | | |
| ID68 | 0.464 | 3.89 | 1.67 | 0 | 0 | 0 | 0.516 | 0.452 | | |
| ID69 | 0.404 | 3.8 | 2.46 | 0 | 0 | 0 | 1.01 | 0.473 | | |
| ID70 | 0.23 | 2.2 | 0 | 0 | 0.12 | 0.006 | 0 | 0 | | |

TABLE 1-continued

| | Compositions | | | | | | | | | |
|---|---|---|---|---|---|---|---|---|---|---|
| | % C | % Mo | % W | % Hf | % Zr | % B | % Ni | % V | Others | REE |
| ID71 | 0.26 | 2.8 | 0 | 0 | 0.18 | 0.006 | 0 | 0 | | |
| ID72 | 0.27 | 3.3 | 0 | 0 | 0.2 | 0.006 | 0 | 0 | | |
| ID73 | 0.23 | 1.8 | 0 | 0 | 0.1 | 0.006 | 0 | 0 | | |
| ID74 | 0.35 | 3.3 | 1.2 | 0 | 0 | 0,002 | 0 | 0 | | |
| ID75 | 0.35 | 3.3 | 1.2 | 0 | 0 | 0.004 | 0 | 0 | | |
| ID76 | 0.55 | 4.9 | 0 | 0.11 | 0.12 | 0.001 | 0.3 | 0.4 | | |
| ID77 | 0.55 | 4.9 | 0 | 0.11 | 0.12 | 0.006 | 0.3 | 0.4 | | |
| ID78 | 0.51 | 3.68 | 0 | 0.11 | 0.12 | 0.009 | 0.29 | 0.4 | | |
| ID79 | 0.35 | 3.3 | 0 | 0 | 0.2 | 0.0005 | 0.4 | 0.4 | | |
| ID80 | 0.35 | 3.3 | 0 | 0 | 0.2 | 0.01 | 0.4 | 0.4 | | |
| ID81 | 0.35 | 3.3 | 0 | 0 | 0.2 | 0.02 | 0.4 | 0.4 | | |
| ID82 | 0.35 | 3.3 | 0 | 0 | 0.2 | 0.0005 | 1.59 | 0 | | |
| ID83 | 0.49 | 4.6 | 0.55 | 0 | 0.2 | 0.0005 | 1.59 | 0.2 | | |
| ID84 | 0.38 | 3.3 | 1 | 0.24 | 0.08 | 0.006 | 0 | 0 | | |
| ID85 | 0.36 | 2.87 | 0.72 | 0 | 0 | 0 | 0.3 | 0 | | |
| ID86 | 0.27 | 3.3 | 0 | 0 | 0 | 0.0002 | 0.26 | 0 | | |
| ID87 | 0.4 | 3.9 | 0.9 | 0 | 0 | 0.006 | 0.18 | 0 | | |
| ID88 | 0.4 | 3.9 | 0.9 | 0 | 0 | 0.006 | 0.18 | 0 | Cr = 0.1 | |
| ID89 | 0.36 | 3.86 | 0 | 0.25 | 0.1 | 0.008 | 0 | 0 | | |
| ID90 | 0.35 | 3.1 | 0 | 0 | 0.2 | 0.006 | 0.4 | 0.4 | Cu = 0.1 | |
| ID91 | 0.42 | 3.8 | 0 | 0 | 0.2 | 0 | 0 | 0 | | |
| ID92 | 0.4 | 3.8 | | | 0.08 | 0.009 | | 0.5 | | |
| ID93 | 0.4 | 3.8 | | | 0.08 | 0.009 | | 0.5 | | |
| ID94 | 0.4 | 3.8 | | | 0.08 | 0.015 | | 0.5 | | |
| ID95 | 0.4 | 3.8 | | | 0.08 | 0.025 | | 0.5 | | |
| ID96 | 0.4 | 3.8 | | | 0.08 | 0.045 | | 0.5 | | |
| ID97 | 0.4 | 3.8 | | | 0.2 | 0.009 | | 0.5 | | |
| ID98 | 0.23 | 2.2 | | | 0.12 | 0.06 | | | | |
| ID99 | 0.26 | 2.8 | | | 0.18 | 0.06 | | | | |
| ID100 | 0.27 | 3.3 | | | 0.2 | 0.06 | | | | |
| ID101 | 0.23 | 1.8 | | | 0.1 | 0.06 | | | | |
| ID102 | 0.23 | 2 | 0 | 0 | 0.08 | 0.006 | 0.4 | 0 | Nb = 0.05 | Ce = 0.03 |
| ID103 | 0.26 | 2.8 | 0 | 0.08 | 0.006 | 0 | 0 | | | |
| ID104 | 0.23 | 2 | 0 | 0 | 0.08 | 0.006 | 0.4 | 0 | | |
| ID105 | 0.23 | 2 | 0 | 0 | 0.08 | 0.0011 | 0.4 | 0 | Nb = 0.03 | Ce = 0.03 |
| ID106 | 0.26 | 2.8 | 0 | 0 | 0.08 | 0.006 | 0.4 | 0 | | |
| ID107 | 0.25 | 1.8 | 0 | 0 | 0.08 | 0.004 | 0.3 | 0 | Nb = 0.05 | La = 0.03 |
| ID108 | 0.23 | 2 | 0 | 0 | 0.08 | 0.0011 | 0.4 | 0 | Nb = 0.03 | Ce = 0.03 |
| ID109 | 0.23 | 2 | 0 | 0 | 0.08 | 0.0011 | 0.4 | 0 | | |
| ID110 | 0.4 | 3.8 | 0 | 0 | 0.08 | 0.0011 | 0.4 | 0 | Nb = 0.03 | Ce = 0.03 |
| ID111 | 0.32 | 3.06 | 2.1 | 0 | 0 | 0 | 3.08 | 0 | Cu = 0.08<br>Mn = 0.16 | |
| ID112 | 0.32 | 3.06 | 2.1 | 0 | 0 | 0 | 3.08 | 0 | Cu = 0.08<br>Mn = 0.16 | Ce = 0.03 |
| ID113 | 0.32 | 3.06 | 2.1 | 0 | 0 | 0 | | 0 | Cu = 0.08<br>Mn = 0.16 | Nd = 0.03 |
| ID114 | 0.39 | 3.82 | | | 0.075 | 0.011 | | 0.56 | | |
| ID115 | 0.39 | 3.9 | | | | 0.008 | 0.4 | 0.57 | Nb = 0.05 | Ce = 0.004 |
| ID116 | 0.39 | 3.6 | | | | 0.006 | 0.35 | 0.55 | Nb = 0.04 | Ce = 0.03 |
| ID117 | 0.4 | 3.9 | | | 0.075 | 0.006 | | | Co = 3 | |
| ID118 | 0.4 | 3.9 | | | 0.075 | 0.006 | | | Cr = 1.6 | |
| ID119 | 0.4 | 3.9 | | | 0.075 | 0.006 | | 0.5 | Co = 3 | |
| ID120 | 0.4 | 3.9 | | | 0.075 | 0.006 | | | | |
| ID121 | 0.4 | 3.9 | | | 0.075 | 0.006 | | 0.5 | | |
| ID122 | 0.4 | 3.9 | | | 0.075 | 0.006 | | | Co = 0.6 | |
| ID123 | 0.3 | 3.3 | 1 | 0.14 | 0.11 | | | | | |
| ID124 | 0.3 | 3.3 | 1 | 0.14 | 0.11 | 0.002 | | | | |
| ID125 | 0.68 | 3.3 | 1 | 0.28 | 0.11 | | | 0.5 | Co = 2.8<br>Mn = 0.6 | |
| ID126 | 0.38 | 3.6 | 1.4 | 0.07 | 0.08 | | | 0.5 | | |
| ID127 | 0.38 | 3.6 | | 0.28 | 0.07 | | | 0.5 | | |
| ID128 | 0.38 | 3.6 | | 0.04 | 0.15 | | | 0.5 | | |
| ID129 | 0.38 | 3.6 | | 0.04 | 0.6 | | | | | |
| ID130 | 0.38 | 3.6 | | 0.14 | 0.5 | | | | | |
| ID131 | 0.32 | 3 | | 0.14 | 1 | | | | Cr = 2.9<br>Si = 0.05<br>Mn = 0.1 | |
| ID132 | 0.4 | 1.5 | | 0.14 | 1.3 | | | 0.3 | Cr = 4.8<br>Si = 0.05<br>Mn = 0.1 | |
| ID133 | 0.38 | 3 | | 0.14 | 1 | | | | Cr = 4.7<br>Si = 0.05<br>Mn = 0.1 | |

TABLE 1-continued

| Compositions | | | | | | | | | |
|---|---|---|---|---|---|---|---|---|---|
| | % C | % Mo | % W | % Hf | % Zr | % B | % Ni | % V | Others | REE |
| ID134 | 1.5 | 6.8 | | | | | | 2.5 | Cu = 3 | |
| ID135 | 0.4 | 3.8 | 1 | | | | | | Al = 2.5<br>Si = 1.3<br>Cr = 1.8 | |
| ID136 | 0.12 | 9.1 | | | | | | 0.3 | Mn = 2.0<br>Cr = 0.8 | |

TABLE 2

| Maximum hardness (HRc) | |
|---|---|
| | Max HRc |
| ID3 | 62 |
| ID7 | 60 |
| ID8 | −58.5 |
| ID11 | 53 |
| ID13 | 54.5 |
| ID14 | 62 |
| ID15 | 53 |
| ID16 | 57 |
| ID19 | 53 |
| ID22 | 55 |
| ID25 | 56 |
| ID28 | 52 |
| ID29 | 52 |
| ID32 | −53.5 |
| ID33 | 54 |
| ID36 | 54.5 |
| ID37 | 60.5 |
| ID38 | 58.5 |
| ID41 | 59 |
| ID42 | 60 |
| ID43 | 61 |
| ID46 | 53 |
| ID47 | 53.5 |
| ID48 | 55 |
| ID49 | 55 |
| ID53 | 54 |
| ID54 | 57 |
| ID92 | 56.5 |
| ID94 | 54.5 |
| ID95 | 53.5 |

TABLE 3

| CVN (J) | | |
|---|---|---|
| | HRc | CVN (J) |
| ID10 | 44.5 | 18 |
| ID12 | 41.5 | 18 |
| ID17 | 44.5 | 16 |
| ID21 | 43 | 20 |
| ID22 | 45 | 19 |
| ID32 | 42 | 13 |
| ID41 | 40.5 | 15 |
| ID53 | 40.5 | 16 |
| ID54 | 43 | 15 |

TABLE 4

| Diffusivity at high hardness | | |
|---|---|---|
| | HRc | d (mm2/s) |
| ID3 | 52.5 | 14.69 |
| ID15 | 53 | 14.41 |
| ID19 | 52.5 | 15.1 |

TABLE 4-continued

| Diffusivity at high hardness | | |
|---|---|---|
| | HRc | d (mm2/s) |
| ID21 | 50 | 14.7 |
| ID22 | 52 | 14.43 |
| ID23 | 50 | 15.01 |
| ID26 | 48 | 15.03 |
| ID27 | 47 | 15.3 |
| ID36 | 54 | 15.246 |
| ID44 | 53 | 14.345 |
| ID50 | 51.5 | 14.429 |
| ID51 | 50 | 15.865 |
| ID53 | 54 | 14.339 |
| ID54 | 56 | 14.373 |

TABLE 5

| Diffusivity at intermediate hardness | | |
|---|---|---|
| | HRc | d (mm2/s) |
| ID15 | 43 | 17.48 |
| ID19 | 43 | 16.8 |
| ID22 | 45 | 16.88 |
| ID25 | 42.5 | 16.54 |
| ID31 | 40-41 | 18.05 |
| ID32 | 42 | 17.543 |
| ID36 | 40 | 17.850 |
| ID38 | 44 | 17.860 |
| ID44 | 42 | 16.717 |
| ID53 | 40.5 | 17.767 |
| ID54 | 43 | 16.56 |
| ID94 | 52 | 14.247 |

TABLE 6

| Diffusivity at low hardness | | |
|---|---|---|
| | HRc | d (mm2/s) |
| ID15 | 37 | 18.33 |
| ID18 | 38 | 17.85 |
| ID21 | 37.5 | 18.8 |
| ID22 | 37 | 17.84 |
| ID28 | 37 | 18.70 |
| ID29 | 35 | 19.17 |
| ID30 | 34.5 | 18.77 |
| ID31 | 36 | 18.74 |
| ID 98 | 33 | 19.04 |
| ID 99 | 35 | 19.47 |
| ID 100 | 33.5 | 19.28 |
| ID 101 | 29 | 19.11 |
| ID 103 | 34 | 17.87 |

TABLE 7

| Diffusivity at high temperatures | | | | |
|---|---|---|---|---|
| | HRc | 200° C. | 400° C. | 600° C. 2 h |
| ID 58 | 48 | 11.10 | 8.22 | 5.75 |
| ID 58 | 42 | 10.59 | 8.18 | 5.89 |
| ID31 | 40-41 | 13.43 | 9.67 | 6.64 |
| ID29 | 35 | 14.01 | 10.01 | 6.78 |

TABLE 8

| v is cooling rate at which ferritic transformation occurs at k/s, considering an austenitizing temperature between 1040° C.-1120° C. | |
|---|---|
| | v (k/s) |
| ID36 | 0.06 |
| ID91 | 0.5 |
| iD115 | 0.08 |
| iD102 | 0.1 |
| iD104 | 0.1 |
| iD105 | 0.05 |
| iD106 | 0.1 |
| iD107 | 0.08 |
| iD40 | 0.08 |
| iD42 | 0.08 |
| iD96 | 0.08 |
| iD49 | 0.05 |
| iD50 | 0.05 |
| iD51 | 0.05 |
| iD44 | 0.2 |
| iD45 | 0.1 |
| iD46 | 0.05 |
| iD47 | 0.05 |

The invention claimed is:

1. A steel, having the following composition, all percentages being in % wt,

| | | | |
|---|---|---|---|
| % Ceq = 0.15-2.0 | % C = 0.15-2.0 | % N = 0-0 | B = 0-4 |
| % Cr = 0-11 | % Ni = 0-0.8 | % Si = 0-2.5 | % Mb = 0-3 |
| % Al = 0-2.5 | % Mo = 0-10 | % W = 0-10 | % Ti = 0-2 |
| % Ta = 0-3 | % Zr = 0-4 | % Hf = 0-3 | % V = 0-12 |
| % Nb = 0-3 | % Cu = 0-2 | % Co = 0-12 | % Moeq = 1.2-<2.8 |
| % La = 0-2 | % Ce = 0-2 | % Nd = 0-2 | % Gd = 0-2 |
| % Sm = 0-2 | % Y = 0-2 | % Pr = 0-2 | % Sc = 0-2 |
| % Pm = 0-2 | % Eu = 0-2 | % Tb = 0-2 | % Dy = 0-2 |
| % Ho = 0-2 | % Er = 0-2 | % Tm = 0-2 | % Yb = 0-2 |
| % Lu = 0-2 | | | |

the rest consisting of iron and trace elements, wherein

% Ceq=% C+0.86*% N+1.2*% B, and

% Moeq=% Mo+½·% W, wherein said steel has a grain size of ASTM 7 or smaller, a microstructure which is at least 65% by volume bainite, and has a thermal diffusivity at room temperature of at least 12 $mm^2/s$.

2. A steel according to claim 1, wherein % B is higher than 1 ppm.

3. A steel according to claim 1, wherein % W<1.

4. A steel according to claim 1, wherein % Ni<0.75.

5. A steel according to claim 1, wherein % C>0.32.

6. A steel according to claim 1, wherein % Cr<1.8.

7. A steel according to claim 1, wherein Mn<0.8%, Cr>2.8 and B>52 ppm.

8. A steel according to claim 1 wherein Mn<0.8%, Cr>2.8, B>52 ppm and the sum of all Rare Earth Elements (REE) is >60 ppm.

9. A steel according to claim 1, wherein the sum of all REE is at least 7 ppm.

10. A steel according to claim 1, wherein % Ce is at least 5 ppm.

11. A steel according to claim 1, wherein % Y is at least 9 ppm.

12. A steel according to claim 1, wherein % Gd is at least 2 ppm.

13. A steel according to claim 1, wherein % Nd is at least 16 ppm.

14. A steel according to claim 1, wherein any REE is present and % V>0.2%.

15. A steel according to claim 1 wherein any REE is present and % Ni>0.1%.

16. A steel according to claim 1, wherein any REE is present and % B<1.64%.

17. A steel according to claim 1, wherein % B is lower than 598 ppm.

18. A steel according to claim 1, wherein % Zr+% Hf+% Ta is higher than 0.3%.

19. A steel according to claim 1, wherein the microstructure of the steel comprises at least 20% of High Temperature bainite, wherein High Temperature bainite, refers to any microstructure formed at temperatures above the temperature corresponding to the bainite nose in the TTT diagram but below the temperature where the ferritic/perlitic transformation ends, but excluding lower bainite which can occasionally be formed in small amounts in isothermal treatments at temperatures above the one of the bainitic nose.

20. A steel according to claim 1, which is a hot work tool steel.

* * * * *